US012544633B2

(12) United States Patent
Milleman et al.

(10) Patent No.: US 12,544,633 B2
(45) **Date of Patent: *Feb. 10, 2026**

(54) GOLF CLUB HEAD HAVING FACE REINFORCING STRUCTURE

(71) Applicant: Karsten Manufacturing Corporation, Phoenix, AZ (US)

(72) Inventors: Travis D. Milleman, Cave Creek, AZ (US); Eric J. Morales, Laveen, AZ (US); Ryan M. Stokke, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/069,960

(22) Filed: Dec. 21, 2022

(65) Prior Publication Data

US 2023/0122759 A1 Apr. 20, 2023

Related U.S. Application Data

(63) Continuation of application No. 17/247,320, filed on Dec. 7, 2020, now Pat. No. 11,534,663, which is a continuation-in-part of application No. 15/804,812, filed on Nov. 6, 2017, now Pat. No. 11,083,935, which is a continuation of application No. 15/004,541, filed on Jan. 22, 2016, now Pat. No. 9,839,818.

(60) Provisional application No. 63/076,859, filed on Sep. 10, 2020, provisional application No. 63/073,849, filed on Sep. 2, 2020, provisional application No. 62/944,968, filed on Dec. 6, 2019, provisional application No. 62/107,269, filed on Jan. 23, 2015.

(51) Int. Cl.
*A63B 53/04* (2015.01)

(52) U.S. Cl.
CPC ..... *A63B 53/0466* (2013.01); *A63B 53/0408* (2020.08); *A63B 53/0437* (2020.08)

(58) Field of Classification Search
CPC ..... A63B 53/0466; A63B 53/0408; A63B 53/0437; A63B 2053/0491
See application file for complete search history.

(56) References Cited

U.S. PATENT DOCUMENTS

| | | | |
|---|---|---|---|
| 5,482,279 | A | 1/1996 | Antonious |
| 5,669,827 | A | 9/1997 | Nagamoto |
| 5,993,329 | A | 11/1999 | Shieh |
| 6,348,013 | B1 | 2/2002 | Kosmatka |

(Continued)

FOREIGN PATENT DOCUMENTS

| | | |
|---|---|---|
| JP | 2004167115 | 6/2004 |
| JP | 6861691 | 4/2021 |

*Primary Examiner* — Steven B Wong

(57) ABSTRACT

Some embodiments of the lightweight golf clubs described herein include a thin crown, a thin sole, a mass efficient weight system, and a thin faceplate to maximize performance gains (e.g., ball travel distance, impact efficiency, and ball speed) targeted to individuals with swing speeds less than 85 mph. As will be further described below, in order to achieve a lightweight golf club head (having a thin crown, a thin sole, a mass efficient weight system, and a thin faceplate), the golf club head further comprises a crown-to-faceplate bridge and a sole-to-faceplate bridge to control the characteristic time (CT) properties of the golf club head.

17 Claims, 8 Drawing Sheets

(56) References Cited

U.S. PATENT DOCUMENTS

| | | | | |
|---|---|---|---|---|
| 6,398,666 | B1 | 6/2002 | Evans | |
| 6,508,722 | B1 | 1/2003 | McCabe | |
| 6,672,975 | B1 | 1/2004 | Galloway | |
| 6,860,818 | B2 * | 3/2005 | Mahaffey | A63B 60/02 473/256 |
| 6,875,129 | B2 * | 4/2005 | Erickson | A63B 60/02 473/345 |
| 7,147,573 | B2 * | 12/2006 | DiMarco | A63B 53/0466 473/335 |
| 7,431,668 | B2 | 10/2008 | Tateno | |
| 7,435,191 | B2 | 10/2008 | Tateno | |
| 7,455,597 | B2 | 11/2008 | Matsunaga | |
| 7,585,233 | B2 | 9/2009 | Horacek | |
| 7,611,424 | B2 * | 11/2009 | Nagai | A63B 60/02 473/335 |
| 7,744,484 | B1 * | 6/2010 | Chao | A63B 60/02 473/409 |
| 7,780,547 | B2 | 8/2010 | Ban | |
| 7,785,214 | B2 | 8/2010 | Horacek | |
| 7,942,759 | B2 | 5/2011 | Matsunaga | |
| 8,033,930 | B2 * | 10/2011 | Tavares | A63B 60/00 473/345 |
| 8,038,546 | B2 | 10/2011 | Yokota | |
| 8,376,879 | B2 | 2/2013 | Wada | |
| 8,465,380 | B2 | 6/2013 | Horacek | |
| 8,678,949 | B2 | 3/2014 | Shimazaki | |
| 8,894,506 | B1 * | 11/2014 | Myers | A63B 60/52 473/335 |
| 8,979,672 | B2 * | 3/2015 | Samson | A63B 60/00 473/329 |
| 9,072,949 | B2 * | 7/2015 | Stites | A63B 53/04 |
| 9,174,100 | B2 | 11/2015 | Takechi | |
| 9,474,944 | B2 | 10/2016 | Ashino | |
| 9,623,294 | B1 * | 4/2017 | Kingston | A63B 60/52 |
| 9,675,849 | B2 * | 6/2017 | Beach | A63B 60/06 |
| 9,694,256 | B2 * | 7/2017 | Myers | A63B 53/0466 |
| 9,839,818 | B2 | 12/2017 | Jertson | |
| 9,908,013 | B2 * | 3/2018 | Hettinger | A63B 53/0466 |
| 10,369,437 | B1 * | 8/2019 | Cleghorn | A63B 53/0466 |
| 10,463,928 | B2 * | 11/2019 | Stokke | A63B 53/06 |
| 11,033,785 | B1 | 6/2021 | Carr | |
| 11,090,536 | B2 * | 8/2021 | Bennett | A63B 53/08 |
| 11,534,663 | B2 * | 12/2022 | Milleman | A63B 60/52 |
| 12,029,950 | B2 * | 7/2024 | Stokke | A63B 53/06 |
| 2004/0018889 | A1 | 1/2004 | Yamamoto | |
| 2005/0124436 | A1 | 6/2005 | Kakiuchi | |
| 2006/0058112 | A1 | 3/2006 | Haralason | |
| 2007/0202963 | A1 | 8/2007 | Oyama | |
| 2007/0275792 | A1 | 11/2007 | Horacek | |
| 2009/0275425 | A1 | 11/2009 | Hirano | |
| 2010/0000071 | A1 | 1/2010 | Rice | |
| 2012/0129627 | A1 | 5/2012 | Hirano | |
| 2012/0172145 | A1 | 7/2012 | Kato | |
| 2013/0029782 | A1 | 1/2013 | Goto | |
| 2013/0102415 | A1 | 4/2013 | Shimazaki | |
| 2013/0324308 | A1 | 12/2013 | Boyd | |
| 2014/0256464 | A1 | 9/2014 | Chao | |
| 2018/0200590 | A1 | 7/2018 | Evans | |
| 2019/0083862 | A1 | 3/2019 | Jertson | |
| 2019/0192927 | A1 | 6/2019 | Bacon | |
| 2019/0201754 | A1 | 7/2019 | Hoffman | |

* cited by examiner

GOLF CLUB HEAD HAVING FACE REINFORCING STRUCTURE

RELATED APPLICATION DATA

This is a continuation of U.S. patent application Ser. No. 17/247,320, filed on Dec. 7, 2020, which is a continuation-in-part of U.S. patent application Ser. No. 15/804,812, filed on Nov. 6, 2017, now U.S. Pat. No. 11,083,935, issued on Aug. 10, 2021, which is a continuation of U.S. patent application Ser. No. 15/004,541, filed on Jan. 22, 2016, now U.S. Pat. No. 9,839,818, issued on Dec. 12, 2017, which claims the benefit of U.S. Provisional Patent Application No. 62/107,269, filed on Jan. 23, 2015. This further claims the benefit of U.S. Provisional Patent Application No. 63/076,859, filed on Sep. 10, 2020, U.S. Provisional Patent Application No. 63/073,849, filed on Sep. 2, 2020, and U.S. Provisional Patent Application No. 62/944,968, filed on Dec. 6, 2019, the entire contents of which are incorporated herein by reference.

FIELD OF INVENTION

The present disclosure relates generally to golf clubs. In particular, the present disclosure relates to golf club heads having one or more thickened regions.

BACKGROUND

Golf can be played by a wide variety of individuals generally categorized by age, gender, physical strength, and flexibility. This diverse group of individuals (or golfers) often leads to golf club manufacturers designing golf clubs that accommodates the full spectrum of golfers, including ones having low, moderate, and high swing speeds. Therefore, often due to golf club manufacturers designing golf clubs that accommodate all individuals; individuals having low and moderate swings speeds may be using golf clubs that are less optimally suited for their specific swing signature. In return, leading to many golfers sacrificing impact efficiency, resulting in a less than maximized ball travel distance. Therefore, there is a need in the art for a golf club head, and more particularly, a driver-type golf club head designed to provide maximum performance to golfers with low and moderate swing speeds.

Figure 1:
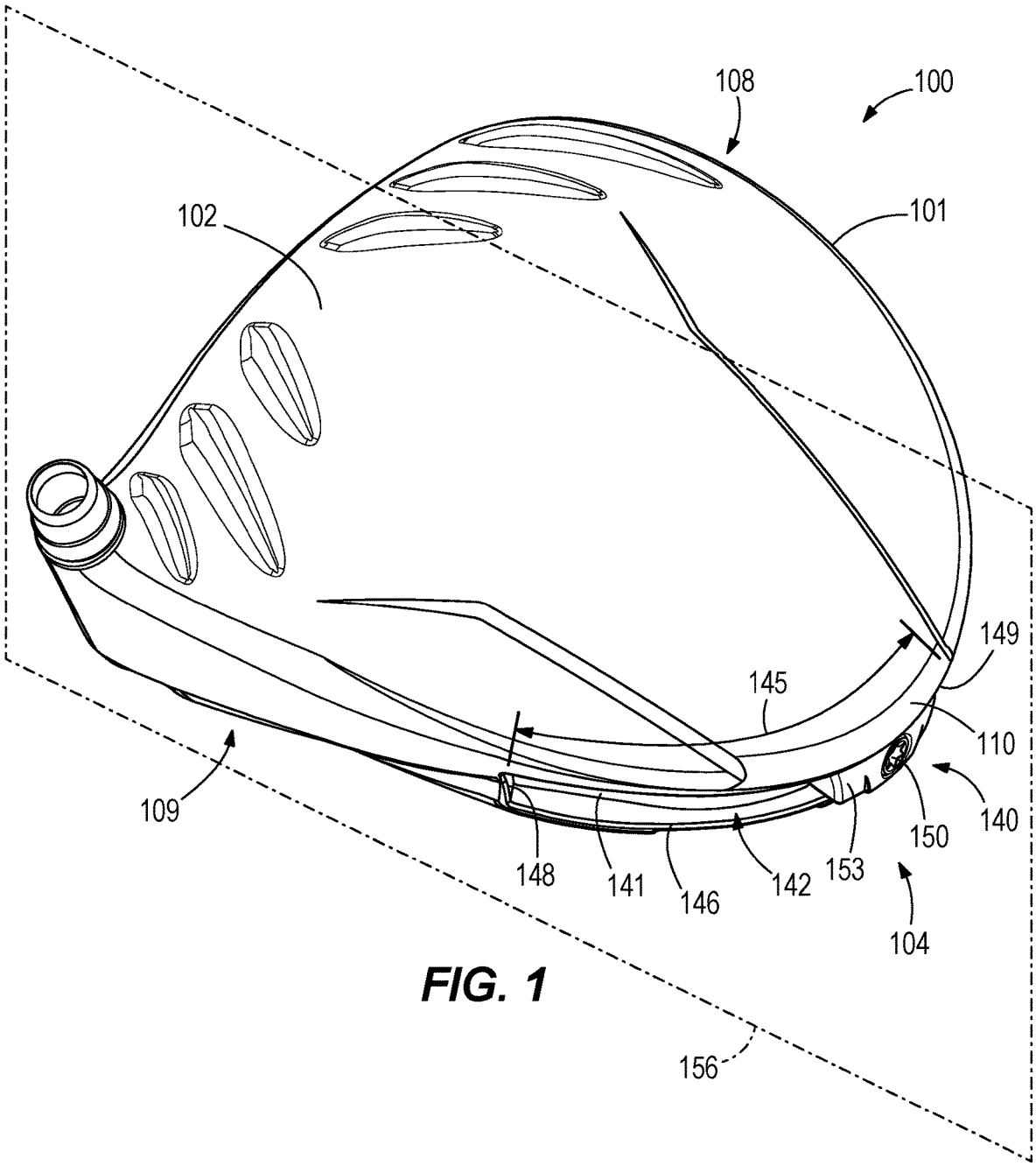
FIG. 1 illustrates an external heel and rear side perspective view of a golf club head.
Figure 2:
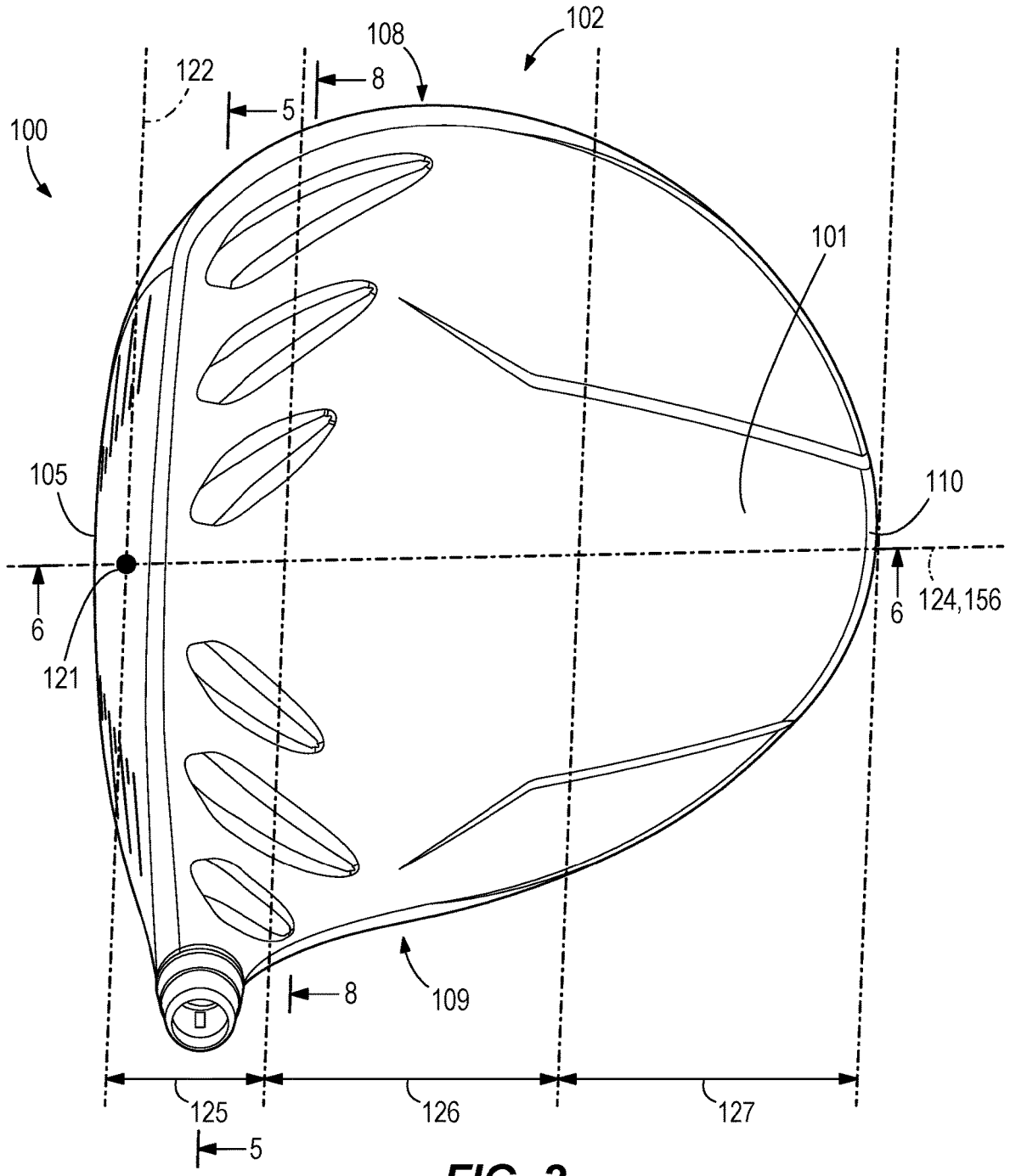
FIG. 2 illustrates an external top or crown view of the golf club head of FIG. 1.
Figure 3:
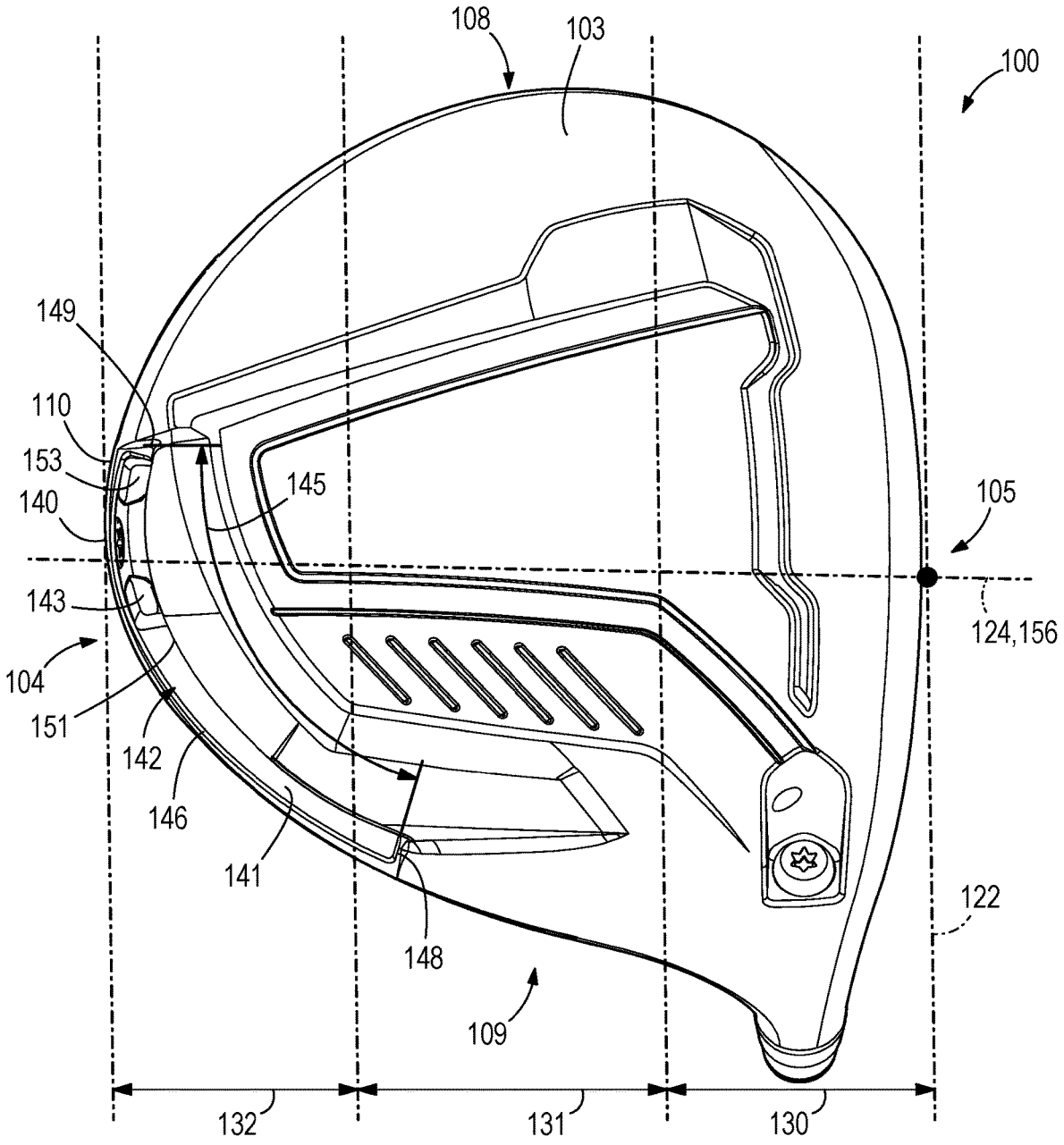
FIG. 3 illustrates an external bottom or sole view of the golf club head of FIG. 1.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denotes the same elements.

DETAILED DESCRIPTION

Presented herein are golf clubs, and in particular, lightweight wood-type golf clubs designed for golfers with swing speeds under 85 mph (e.g., low and moderate swing speeds). Generally, the lightweight golf clubs described herein may comprise a thin crown, a thin sole, a mass efficient weight system, and/or a thin faceplate to maximize performance gains (e.g., ball travel distance, impact efficiency, and ball speed) targeted to individuals with swing speeds less than 85 mph. As will be further described below, in order to achieve a lightweight golf club (having a thin crown, a thin sole, a mass efficient weight system, and a thin faceplate), the golf club head further comprises a crown-to-faceplate bridge and a sole-to-faceplate bridge to control the characteristic time (CT) properties of the club head.

Creating golf clubs that are specifically targeted to specific swing speed demographics (i.e. low and moderate swing speeds) can allow these individuals to use golf clubs suited to their swing signature, rather than using golf clubs configured to accommodate the full spectrum of golfers (i.e. low, moderate, and high swing speeds). Therefore, this reduces the need to create golf club heads that can withstand the ultimate loading (and/or ultimate stress) conditions imparted from high speed swing speeds for durability purposes. This allows the golf club heads described herein to have a decreased club head mass-to-volume ratio, improved mass placement, and a thinner faceplate.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The golf club head described herein can be a driver-type club head, a fairway wood-type golf club, or a hybrid-type club head as described below. In many embodiments, the golf club head can be a wood-type golf club head (i.e. a driver-type golf club head, a fairway wood-type golf club head, or a hybrid-type golf club head). Driver-type golf club heads, fairway wood-type golf club heads, and hybrid-type golf club heads can be characterized by a loft angle, a head volume, and/or by a head weight as mentioned above.

1. Loft Angle—Driver

The term "driver-type golf club head" described herein can be defined by a loft angle.

In many embodiments, the loft angle of the driver-type club head can be less than approximately 16 degrees, less than approximately 15 degrees, less than approximately 14 degrees, less than approximately 13 degrees, less than approximately 12 degrees, less than approximately 11 degrees, less than approximately 10 degrees, less than approximately 9 degrees, less than approximately 8 degrees, or less than approximately 7 degrees.

2. Loft Angle—Fairway Wood

The term "fairway wood-type golf club head" described herein can be defined by one or more of a loft angle or a club head material.

In many embodiments, the loft angle of the fairway wood-type club head can be less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the club head is greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in some embodiments, the loft angle of the fairway wood-type club head can be between 12 degrees and 35 degrees, between 15 degrees and 35 degrees, between 20 degrees and 35 degrees, or between 12 degrees and 30 degrees.

3. Material—Fairway Wood

The material of the fairway wood-type golf club head can be constructed from any material used to construct a conventional golf club head. For example, the material of the fairway wood-type golf club head can be constructed from any one or combination of the following: 8620 alloy steel, S25C steel, carbon steel, maraging steel, 17-4 stainless steel, 1380 stainless steel, 303 stainless steel, stainless steel alloys, steel alloys, tungsten, aluminum, aluminum alloys, ADC-12, titanium, titanium alloys, steel alloys or any other known metal or composite material for creating a fairway wood-type golf club head. In many embodiments, the fairway wood-type golf club head is constructed from a titanium alloy and/or composite material.

4. Loft Angle—Hybrid

The term "hybrid-type golf club head" described herein can be defined by one or more of a loft angle or a club head material.

In many embodiments, the loft angle of the hybrid-type club head can be less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the hybrid-type club head is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

5. Material—Hybrid

The material of the hybrid-type golf club head can be constructed from any material used to construct a conventional golf club head. For example, the material of the hybrid-type golf club head can be constructed from any one or combination of the following: 8620 alloy steel, S25C steel, carbon steel, maraging steel, 17-4 stainless steel, 1380 stainless steel, 303 stainless steel, stainless steel alloys, steel alloys, tungsten, aluminum, aluminum alloys, ADC-12, titanium, titanium alloys, steel alloys or any other known metal or composite for creating a hybrid-type golf club head. In many embodiments, the hybrid-type golf club head can be constructed from a titanium alloy and/or composite material.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Described below are lightweight golf club heads having a mass conservative faceplate and a mass conservative body compared to golf club heads designed for swing speeds in excess of 100 miles per hour. The body and the faceplate together form the golf club head defining a hollow interior. The body comprises a crown, a sole, a toe, a heel, and a rear portion defining an inner cavity. The crown, sole, toe, and heel of the body define an opening configured to receive the faceplate.

As described above, in many embodiments, the faceplates described herein can be designed according to a specific swing speed demographic. By way of a non-limiting example, a first user demographic having swing speeds less than 85 miles per hour (mph) can use golf clubs having a thinner faceplate (thereby a less mass intensive faceplate), than a second user demographic with swing speeds in excess of 100 miles per hour (mph). This allows the first user demographic to experience greater ball speeds and increased ball travel distance (due to increased face flexure caused by thinning of the faceplate), in comparison, to using golf club heads designed for the second user demographic and both, maintaining their durability. In this specific scenario, a durability issue caused by thinning the faceplate is not readily present (to the first user demographic) due to lowto-moderate impact speeds, however, thinning the thickness of the faceplate can result in an unconstrained increase in CT.

In many embodiments, to adequately control or modify CT across the faceplate (while maintaining a thin and lightweight faceplate), the faceplate can have a variable thickness profile, which tunes CT by allowing for thickening only desired regions. However, in contrast, to golf club heads designed for swing speeds greater than 100 miles per hour, simply implementing a variable face thickness profile would be insufficient to adequately control CT. Therefore, a crown-to-faceplate bridge and a sole-to-faceplate bridge are internally and integrally formed within the club head to further control, modify, and/or reduce the characteristic time properties (CT) of the club head.

The variable thickness of the faceplate can comprise a perimeter edge region, a toe region, a heel region, an upper transition region, a lower transition region, and a center region. The perimeter edge region can be substantially ellipsoidal and circumscribes the toe region, the heel region, the upper transition region, the lower transition region, and the center region. The toe region spans from the border of the perimeter edge, the upper transition region, and the lower transition region. The heel region spans from the border of the perimeter edge, the upper transition region, and the lower transition region. The center region spans from and bounded by the upper and lower transition region. In many embodiments, from the heel end of the golf club head to the center of the faceplate and from the toe end of the golf club head to the center of the faceplate, the variable thickness of the faceplate (VFT) can be defined as the perimeter edge being the outermost region, followed up the heel and toe portions, the upper and lower transition region, and lastly the center region.

Generally, portions of the golf club head having the greatest characteristic time measurements can typically be found (1) towards the geometric center of the faceplate, (2) offset from the geometric center of the faceplate towards the toe of the faceplate, (3) offset from the geometric center towards the top end of the faceplate, or combinations thereof. These areas can potentially have a characteristic time measurement that is at, near, or approaching a threshold CT value (i.e. a USGA and R&A CT limit). Therefore, in one or more thin faceplate embodiments, it may be desirable to reduce CT in the toe portion of the faceplate and increase CT in the heel portion of the faceplate. In these situations, the toe region of the VFT can have a greater thickness than the heel region of the VFT. This creates a faceplate this is stiffer within the toe portion and more flexible within the heel portion. Thereby, in part, creating a more uniform CT across the faceplate.

As mentioned above, having a faceplate with a variable face thickness profile facilitates in controlling (and/or decreasing) CT, however, due to the increased face flexure caused by a thin and lightweight faceplate, solely implementing a VFT is insufficient to adequately controlling CT. Therefore, to further modulate CT, without adding mass intensive features, the golf club head can comprise a crown-to-faceplate bridge and/or a sole-to-faceplate bridge. The crown-to-faceplate bridge and/or the sole-to-faceplate bridge can be positioned in portions of the golf club head that are subjected to low displacement and/or low stress regions upon golf ball impact. This allows certain portions of a transition region between the faceplate and the crown and/or certain portions of the transition region between the faceplate and the sole to be reinforced/thicker to provide localized and/or custom stiffening to adjust the dynamic response properties of the golf club head (i.e. CT), while having a negligible effect on impact ball speeds.

Composition and Setup of Golf Club Head

As will be further described below, in order to achieve a lightweight golf club that satisfies a predetermined mass/volume ratio, the golf club head comprises a thin crown, a thin sole, a mass efficient weight system, and a thin faceplate when compared to a conventional club head designed for swing speeds over 100 miles per hour. Thinning these structural features (i.e. the thin crown, the thin sole, the mass efficient weight system, and the thin faceplate), increases the flexibility of the golf club head, which correlates to an increase in CT. Therefore, to limit (or offset) the increase in CT and ensure the club is in conformance with USGA, the golf club head further comprises a crown-to-faceplate bridge and/or a sole-to-faceplate bridge to control (or lower) the characteristic time (CT) properties of the club head without needing to increase the thickness of the faceplate (i.e. not limiting the flexibility of the faceplate). The club heads are achieving these characteristics with swing speeds less than 85 miles per hour.

In many embodiments, the golf club head comprises a club head body (may also be referred to as "body"). The club head body forms a toe (or toe portion), a heel (or heel portion), a crown (or crown portion), a sole (or sole portion), a rear portion and a faceplate opening configured to receive a faceplate. The faceplate can provide a surface adapted for impact with a golf ball. The rear portion is rearwardly spaced from the faceplate. The sole portion is defined as being between the faceplate and the rear portion, and resting on a ground plane (or playing surface) at an address position. The crown (or crown portion) can be formed opposite the sole (or sole portion). The faceplate can be defined by the sole, the crown, the heel, and the toe of the golf club head.

As previously mentioned, the golf club head can be configured to reside in the "address position". Unless otherwise described or stated, the golf club head is in an address position for all reference measurements, ratios, and/or descriptive parameters. The address position can be referred to as being in a state where (1) the sole of the golf club head rests on the ground plane, which contacts and is parallel to a playing surface and (2) the faceplate can be substantially perpendicular to the ground plane.

The faceplate of the clubhead defines a geometric center. In some embodiments, the geometric center can be located at the geometric centerpoint of a faceplate perimeter, and at a midpoint of face height. In the same or other examples, the geometric center also can be centered with respect to an engineered impact zone, which can be defined by a region of grooves on the faceplate. As another approach, the geometric center of the faceplate can be located in accordance with the definition of a golf governing body such as the United States Golf Association (USGA). For example, the geometric center of the faceplate can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

The club head further defines a loft plane tangent to the geometric center of the faceplate. The face height can be measured parallel to the loft plane between a top end of the faceplate perimeter near the crown and a bottom end of the faceplate perimeter near the sole. In these embodiments, the perimeter of the faceplate can be located along the outer edge of the faceplate where the curvature deviates from the bulge and/or roll of the faceplate.

The geometric center of the faceplate further defines a coordinate system having an origin located at the geometric center of the faceplate, the coordinate system having an X' axis, a Y' axis, and a Z' axis. The X' axis extends through the geometric center of the faceplate in a direction from the heel to the toe of the club head. The Y' axis extends through the geometric center of the faceplate in a direction from the crown to the sole of the club head and perpendicular to the X' axis, and the Z' axis extends through the geometric center of the faceplate in a direction from the front end (e.g., faceplate) to the rear of the club head and perpendicular to the X' axis and the Y' axis.

The coordinate system defines an X'Y' plane extending through the X' axis and the Y' axis. The X'Y' plane extends parallel to a hosel axis (not shown) and is positioned at an angle corresponding to the loft angle of the club head from the loft plane 164. Further, the X' axis can be positioned at a 60 degree angle to the hosel axis when viewed from a direction perpendicular to the X'Y' plane. In these or other embodiments, the club head can be viewed from a front view (FIG. 4) when the faceplate is viewed from a direction perpendicular to the X'Y' plane.

I. Embodiments

Many of the golf club head embodiments (FIGS. 1-11) described below, illustrate a driver-type golf club head 100 configured to increase performance for golfers with swing speeds under 85 miles-per-hour (mph). As will be further described below, increased performance can be at least in part attributed to the addition of a crown-to-faceplate bridge 106 and/or a sole-to-faceplate bridge 107, a thin crown 102, a thin sole 103, a lightweight and flexible faceplate 105 with a variable thickness profile 111, and a mass-efficient weight system 104. As will be discussed below, the combination of these features and attributes aid in preventing durability and CT issues, while increasing club head performance to golfers with swing speeds under 85 miles per hour.

Mass Properties of the Golf Club Head

Referring to FIGS. 1-11, the body 101 of the golf club head 100, and the faceplate 105 are coupled together to define a hollow interior cavity. The body 101 comprises a crown 102, a sole 103, a toe 108, a heel 109, and a rear portion 110 defining a hollow inner cavity. The crown 102, the sole 103, the toe 108, and the heel 109 of the body define an opening configured to receive the faceplate 105. The faceplate 105 can provide a surface adapted for impact with a golf ball. The rear portion 110 is rearwardly spaced from the faceplate 105. The sole 103 is defined as being between the faceplate 105 and the rear portion 110 and resting on a ground plane 120 (or playing surface) at an address position. The crown 102 can be formed opposite the sole 103.

Creating golf club heads used (only) by golfers with swing speeds under 85 miles per hour permits reducing (or thinning) the structural mass of many features of the club head (i.e. the crown, the sole, the faceplate, etc.) then conventionally required by golf club heads used by golfers with swing speeds in excess of 100 miles per hour (conventional golf clubs). This creates a golf club head that is significantly more flexible than conventional golf clubs, which consequently causes an increase in the CT properties of the club head. Therefore, implementing an integrally formed crown-to-faceplate bridge or a sole-to-faceplate bridge can locally thicken a region of the club head having inherently high CT without needing to add thickness (or mass) to the entire faceplate. In conventional clubheads, the primary option to decrease the CT properties of the club head is to thicken the entire face (and not just a face periphery portion). Therefore, the crown-to-faceplate bridge and the sole-to-faceplate bridge aid in creating a lightweight golf club head. In many embodiments, the golf club head 100 can be approximately 3 grams, approximately 4 grams, approximately 5 grams, approximately 6 grams, approximately 7 grams, approximately 8 grams, or approximately 9 grams lighter than the conventional golf club head.

Driver-Type Golf Club Head

To achieve a lightweight (but durable) golf club head 100, the combined mass of the golf club head 100 can be between approximately 190 grams and 200 grams. In many embodiments, the combined mass of the golf club head 100 can be between approximately 190 grams-192 grams, approximately 192 grams-194 grams, approximately 194 grams-196 grams, approximately 196 grams-198 grams, or approximately 198 grams-200 grams. In further embodiments, the combined mass of the golf club head 100 can be less than 200 grams, less than 199 grams, less than 198 grams, less than 197 grams, less than 196 grams, less than 195 grams, less than 194 grams, less than 193 grams, less than 192 grams, or less than 191 grams. In other embodiments, the combined mass of the golf club head 100 can be approximately 190 grams, approximately 191 grams, approximately 192 grams, approximately 193 grams, approximately 194 grams, approximately 195 grams, approximately 196 grams, approximately 197 grams, approximately 198 grams, approximately 199 grams, or approximately 200 grams. In the illustrated embodiment of FIGS. 1-11, the combined club head mass (i.e. the club head body coupled to the faceplate) is approximately 194 grams. For comparison purposes, conventional golf club heads designed for swing speeds over 100 miles per hour have a combined club head mass in excess of 203 grams.

Creating a lightweight golf club head 100 does not necessarily mean a tradeoff (or decrease) in the volume of the clubhead 100. For example, the volume of the golf club head 100 can be between approximately 444 cc and approximately 460 cc. In many embodiments, the volume of the golf club head 100 can be between approximately 444 cc-approximately 448 cc, approximately 448 cc-approximately 450 cc, approximately 450 cc-approximately 452 cc, approximately 452 cc-approximately 454 cc, approximately 454 cc-approximately 456 cc, approximately 456 cc-approximately 458 cc, or approximately 458 cc-approximately 460 cc. In other embodiments, the volume of the golf club head 100 can be approximately 444 cc, approximately 445 cc, approximately 446 cc, approximately 447 cc, approximately 448 cc, approximately 449 cc, approximately 450 cc, approximately 451 cc, approximately 452 cc, approximately 453 cc, approximately 454 cc, approximately 455 cc, approximately 456 cc, approximately 457 cc, approximately 458 cc, approximately 459 cc, or approximately 460 cc. In the illustrated embodiment of FIGS. 1-11, the combined club head 100 volume is 460 cc.

In many embodiments, the golf club head 100 can be characterized by a mass-to-volume ratio that is defined as the ratio between the mass of the golf club head and the volume of the golf club head (Mass of the Golf Club Head (grams)/Volume of the Golf Club Head (cubic centimeters)).

In many embodiments, the mass-to-volume ratio of the golf club head 100 can be between approximately 0.40 and approximately 0.44. In many embodiments, the mass-to-volume ratio of the golf club head 100 can be greater than approximately 0.40, greater than approximately 0.41, greater than approximately 0.42, or greater than approximately 0.43. In the same or other embodiments, the mass-to-volume ratio of the golf club head 100 can be less than approximately 0.44, less than approximately 0.43, less than approximately 0.42, or less than approximately 0.41. In alternative embodiments, the mass-to-volume ratio of the golf club head 100 can be approximately 0.40, approximately 0.41, approximately 0.42, approximately 0.43, or approximately 0.44. The mass-to-volume ratio is unitless as one gram is mathematically equivalent to one cubic centimeter.

Maintaining a golf club head 100 with a mass-to-volume ratio that is less than 0.44 enables individuals with lower swing speeds to swing freely and naturally without sacrificing forgiveness (MOI) typically associated with a larger volume club head. The ratio described above is achieved through various features that will be further detailed below.

Fairway Wood Golf Club Head

To achieve a lightweight (but durable) golf club head, the combined mass of the golf club head can be between approximately 180 grams and 198 grams. In many embodiments, the combined mass of the golf club head can be between approximately 180 grams-182 grams, approximately 182 grams-184 grams, approximately 184 grams-186 grams, approximately 186 grams-188 grams, approximately 188 grams-190 grams, approximately 190 grams-approximately 192 grams, approximately 192 grams-approximately 194 grams, approximately 194 grams-approximately 196 grams, or approximately 196 grams-approximately 198 grams. In further embodiments, the combined mass of the golf club head can be less than 198 grams, less than 197 grams, less than 196 grams, less than 195 grams, less than 194 grams, less than 193 grams, less than 192 grams, less than 191 grams, less than 190 grams, less than 189 grams, less than 188 grams, less than 187 grams, less than 186 grams, less than 185 grams, less than 184 grams, less than 183 grams, less than 182 grams, or less than 181 grams. In other embodiments, the combined mass of the golf club head can be approximately 180 grams, approximately 181 grams, approximately 182 grams, approximately 183 grams, approximately 184 grams, approximately 185 grams, approximately 186 grams, approximately 187 grams, approximately 188 grams, approximately 189 grams, approximately 190 grams, approximately 191 grams, approximately 192 grams, approximately 193 grams, approximately 194 grams, approximately 195 grams, approximately 196 grams, approximately 197 grams, or approximately 198 grams. For comparison purposes, conventional fairway-wood type golf club heads designed for swing speeds over 100 miles per hour have a combined club head mass between 200 grams and 208 grams.

Creating a lightweight golf club head does not necessarily mean a tradeoff (or decrease) in the volume of the clubhead. For example, the volume of the golf club head can be between approximately 165 cc and approximately 180 cc. In many embodiments, the volume of the golf club head can be between approximately 165 cc-approximately 170 cc, approximately 170 cc-approximately 175 cc, or approximately 175 cc-approximately 180 cc. In other embodiments, the volume of the golf club head can be approximately 165 cc, approximately 166 cc, approximately 167 cc, approximately 168 cc, approximately 169 cc, approximately 170 cc, approximately 171 cc, approximately 172 cc, approximately 173 cc, approximately 174 cc, approximately 175 cc, approximately 176 cc, approximately 177 cc, approximately 178 cc, approximately 179 cc, or approximately 180 cc.

In many embodiments, the golf club head can be characterized by a mass-to-volume ratio that is defined as the ratio between the mass of the golf club head and the volume of the golf club head $$\left(\frac{\text{Mass of the Golf Club Head (grams)}}{\text{Volume of the Golf Club Head (cubic centimeters)}}\right).$$

In many embodiments, the mass-to-volume ratio of the golf club head can be between approximately 1.04 and approximately 1.07. In many embodiments, the mass-to-volume ratio of the golf club head can be greater than approximately 1.04, greater than approximately 1.05, greater than approximately 1.06, or greater than approximately 1.07. In the same or other embodiments, the mass-to-volume ratio of the golf club head can be less than approximately 1.07, less than approximately 1.06, or less than approximately 1.05. In alternative embodiments, the mass-to-volume ratio of the golf club head can be approximately 1.04, approximately 1.05, approximately 1.06, or approximately 1.07. The mass-to-volume ratio is unitless as one gram is mathematically equivalent to one cubic centimeter.

Maintaining a golf club head with a mass-to-volume ratio that is less than 1.07 enables individuals with lower swing speeds to swing freely and naturally without sacrificing forgiveness (MOI) typically associated with a larger volume club head. The ratio described above is achieved through various features that will be further detailed below. Similar mass-to-volume ratio can be achieved with a hybrid-type golf club head.

Crown of the Golf Club Head

As described above, creating golf club heads used only by golfers with swing speeds only under 85 miles per hours permits reducing (or thinning) the structural mass of many features of the club head (i.e. the crown, the sole, the faceplate, etc.) then conventionally constrained to (for durability purposes) by golf club heads configured used by golfers with swing speeds in excess of 100 miles per hour (conventional golf clubs). Thinning the crown of the golf club head provides a lower and deeper center of gravity position to help launch the golf ball into the air quicker upon impact. However, this can create a golf club head that has a thinner crown-to-face transition region than conventional golf clubs, which consequently can cause an increase in the CT properties of the club head. Therefore, locally implementing an integrally formed crown-to-faceplate bridge that is tangentially blended with some of surrounding areas of the club head can decrease CT, while negligibly increasing the club head mass and maintaining a thin crown.

In many embodiments, the golf club head 100 can have a crown 102 with a relatively lower thickness (than a standard club that must maintain durability over 100 mph impacts) to achieve certain head mass and volume targets. As defined above, the crown 102 of the golf club 100 is the top surface of the club head and the portion of the club visible from an address position, when the individual or golfer (not shown) is looking down. The crown 102 can be segmented (or split)

into three distinct length portions (i.e. a front portion 125, a middle portion 126, and a rear portion 127), measured in a front-to-rear direction from the rear of the golf club head 110 to the faceplate 105.

The front portion 125 of the crown 102 can be proximal to the faceplate 105 and defined as the forward $1/6^{th}$ portion (and/or having a length that is $1/6^{th}$) of the crown length. The rear portion 127 of the crown 102 is proximal to the rear 110 of the golf club head 100 and defined as being the rearward $2/6^{th}$ portion (and/or having a length that is $2/6^{th}$) of the crown length. The middle portion 126 of the crown 102 is between the front portion 125 and rear portion 127 and defined as being the middle $3/6^{th}$ portion (and/or having a length that is $3/6^{th}$) of the crown length.

Figure 6:
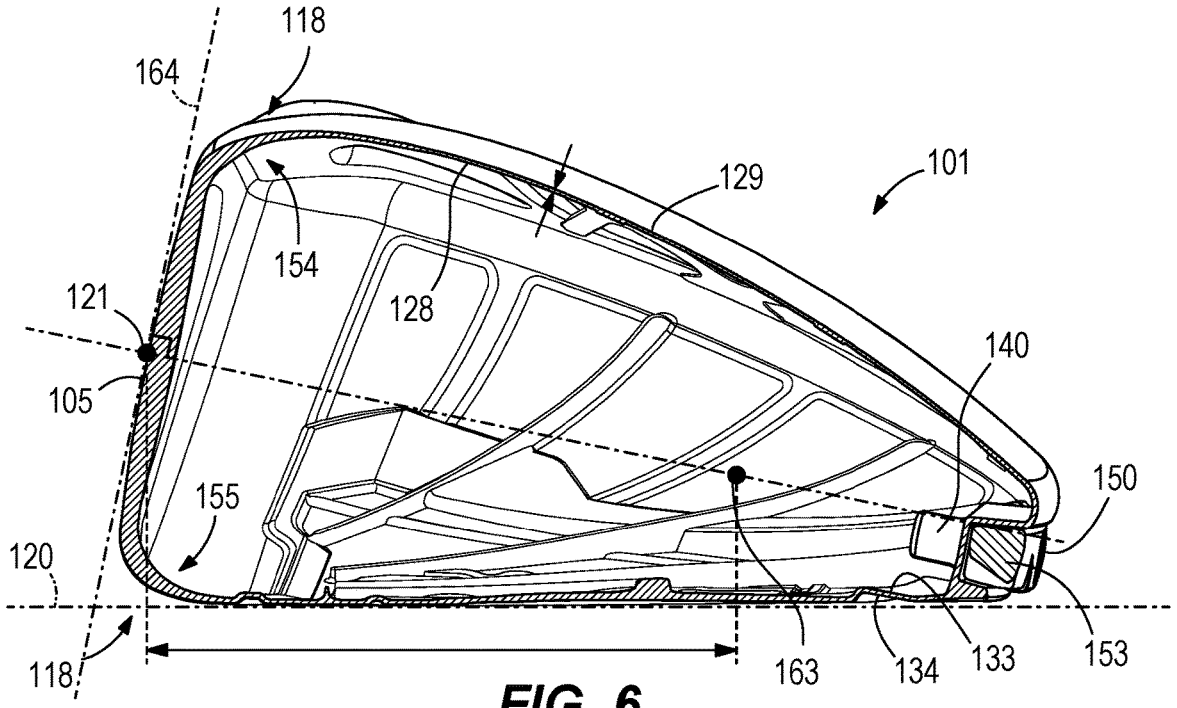
FIG. 6 illustrates a cross sectional view of the golf club head of FIG. 1 having a weight assembly affixed to the club head.
Figure 7:
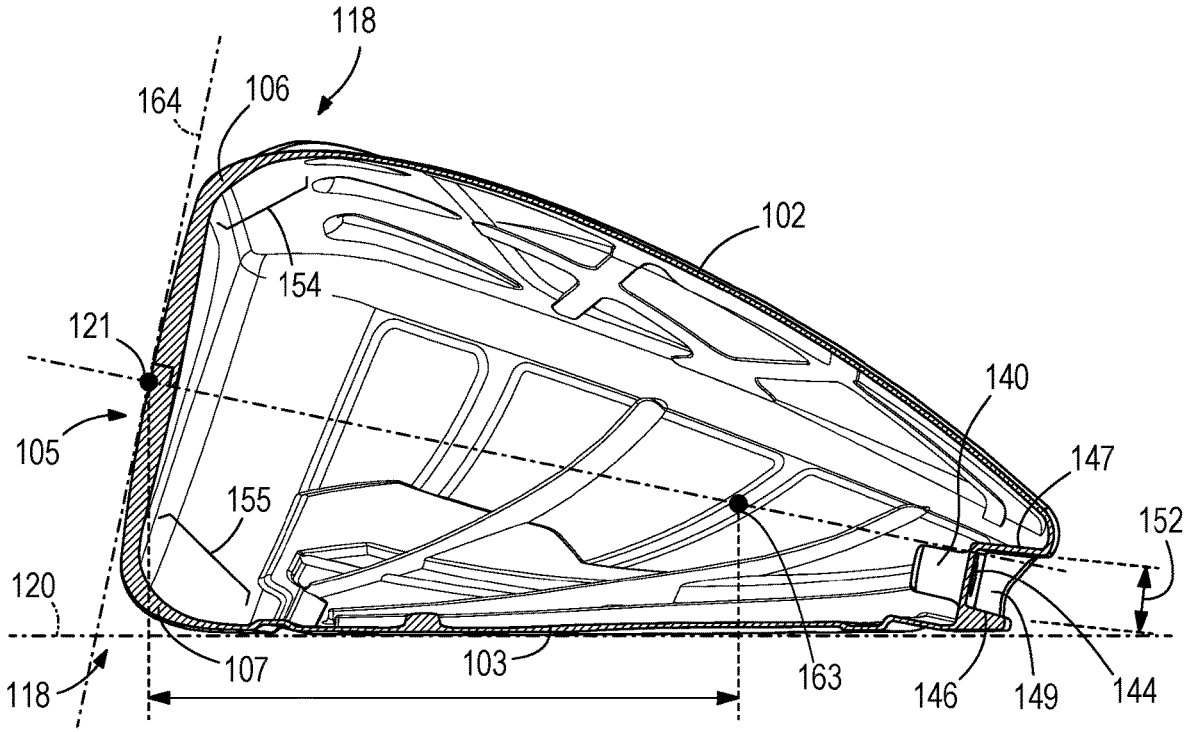
FIG. 7 illustrates a cross sectional view of the golf club head of FIG. 1 without a weight assembly affixed to the club head.

In this or other embodiments, the thickness of the crown 102 can vary from near the front portion 125 of the crown 102 to near the rear end 110 of the crown 102 and/or from near the heel portion of the crown 102 to near the toe portion of the crown 102, or in any direction along the crown 102 of the golf club head. As illustrated by FIGS. 6 and 7, in many embodiments, the thickness of the crown 102 can decrease from near the front end towards the rear end of the golf club head 100, measured from an inner crown surface 128 to an outer crown surface 129.

For example, in many embodiments, the thickness of the front portion 125 of the crown 102 can be between 0.019 inches and 0.031 inches. In other embodiments, the thickness of the front portion 125 of the crown 102 can be less than approximately 0.031 inches, less than approximately 0.030 inches, less than approximately 0.029 inches, less than approximately 0.028 inches, less than approximately 0.027 inches, less than approximately 0.026 inches, less than approximately 0.025 inches, less than approximately 0.024 inches, less than approximately 0.023 inches, less than approximately 0.022 inches, less than approximately 0.021 inches, or less than approximately 0.020 inches. In other embodiments, the thickness of the front portion 125 of the crown 102 can be approximately 0.019 inch, approximately 0.020 inch, approximately 0.021 inch, approximately 0.022 inch, approximately 0.023 inch, approximately 0.024 inch, approximately 0.025 inch, approximately 0.026 inch, approximately 0.027 inch, approximately 0.028 inch, approximately 0.029 inch, approximately 0.030 inch, or approximately 0.031 inch.

In the same or an alternative embodiment, the thickness of the middle 126 and rear portion 127 of the crown 102 can be the same or substantially equivalent. For example, in many embodiments, the thickness of the middle portion 126 and rear portion 127 of the crown 102 can be between 0.014 inches and 0.020 inches. In other embodiments, the thickness of the middle portion 126 and rear portion 127 of the crown 102 can be less than approximately 0.020 inches, less than approximately 0.019 inches, less than approximately 0.018 inches, less than approximately 0.017 inches, less than approximately 0.016 inches, or less than approximately 0.015 inches. In other embodiments, the thickness of the middle portion 126 and rear portion 127 of the crown 102 can be approximately 0.014 inches, approximately 0.015 inches, 0.016 inches, 0.017 inches, 0.018 inches, 0.019 inches, or 0.020 inches. In alternative embodiments, the middle portion 126 of the crown can be a transition region from thickest front portion 125 to the thinnest rear portion 127 of the crown.

Stated another way, in many embodiments, approximately 85% of the crown 102 can have a thickness of approximately 0.017 inches and the reaming portion of the crown 102 can have a thickness of approximately 0.031 inches. For comparison purposes, conventional golf club heads that maintains durability with swing speeds over 100 miles per hour have an average thickness of 0.031 inches over the majority of the crown.

Sole of the Golf Club Head

As described above, creating golf club heads configured to be used by golfers with swing speeds under 85 miles per hours permits reducing (or thinning) the structural mass of many features of the club head (i.e. the crown, the sole, the faceplate, etc.) then conventionally constrained to by golf club heads used by golfers with swing speeds in excess of 100 miles per hour (conventional golf clubs). Thinning the sole of the golf club head allows the faceplate to deform and bend more (i.e. more faceplate deflection yields greater ball speeds) than a conventional club head that maintains durability over 100 miles per hour. However, this can create a golf club head that has a thinner sole-to-face transition region than conventional golf clubs, which consequently can cause an increase in the CT properties of the club head. Therefore, locally implementing an integrally formed sole-to-faceplate bridge that is tangentially blended with the some surrounding areas of the club head can decrease (or control) CT, while negligibly increasing the club head mass and maintaining a thin sole.

In many embodiments, the golf club head 100 can have a sole 103 with a relatively lower thickness (than a standard club that must maintain durability over 100 mph impacts) to achieve certain head mass and volume targets. As defined above, the sole 103 of the golf club head 100 is between the faceplate 105 and the rear portion 110 and resting on a ground plane 120 (or playing surface) at an address position. The sole 103 can be segmented (or split) into three distinct length portions (i.e. a front sole portion 130, a middle sole portion 131, and a rear sole portion 132), measured in a front-to-rear direction from the faceplate-to-rear of the golf club head.

The front sole portion 130 of the sole 103 can be proximal to the faceplate 105 and the forward $1/3^{rd}$ portion (and/or having a length that is $1/3^{rd}$) of the sole length. The rear sole portion 132 of the sole 103 is proximal to the rear 110 of the golf club head and defined as being the rearward $1/3^{rd}$ portion (and/or having a length that is $1/3^{rd}$) of the sole length. The middle sole portion 131 of the sole is between the front sole portion 130 and rear sole portion 132 and defined as being the middle $1/3^{rd}$ portion (and/or having a length is $1/3^{rd}$) of the sole length.

In this or other embodiments, the thickness of the sole 103, measured from an inner sole surface 133 to an outer sole surface 134, can vary from near the front portion of the sole to near the rear end of the sole and/or from near the heel portion of the sole to near the toe portion of the sole, or in any direction along the sole of the golf club head. In many embodiments, the thickness of the sole 103 can decrease from near the front end towards the rear end 110 of the golf club head 100.

For example, in many embodiments, the thickness of the front portion 130 of the sole 103 can be between 0.019 inches and 0.031 inches. In other embodiments, the thickness of the front portion 130 of the sole 103 can be less than approximately 0.031 inches, less than approximately 0.030 inches, less than approximately 0.029 inches, less than approximately 0.028 inches, less than approximately 0.027 inches, less than approximately 0.026 inches, less than approximately 0.025 inches, less than approximately 0.024 inches, less than approximately 0.023 inches, less than approximately 0.022 inches, less than approximately 0.021 inches, or less than approximately 0.020 inches. In other embodiments, the thickness of the front portion 130 of the sole 103 can be approximately 0.019 inch, approximately 0.020 inch, approximately 0.021 inch, approximately 0.022 inch, approximately 0.023 inch, approximately 0.024 inch, approximately 0.025 inch, approximately 0.026 inch, approximately 0.027 inch, approximately 0.028 inch, approximately 0.029 inch, approximately 0.030 inch, or approximately 0.031 inch.

In the same or an alternative embodiment, the thickness of the middle 131 and rear portion 132 of the sole 103 can be the same or substantially equivalent. For example, in many embodiments, the thickness of the middle portion 131 and rear portion 132 of the sole 103 can be between 0.014 inches and 0.022 inches. In other embodiments, the thickness of the middle portion 131 and rear portion 132 of the sole 103 can be less than approximately 0.022 inches, less than approximately 0.021 inches, less than approximately 0.020 inches, less than approximately 0.019 inches, less than approximately 0.018 inches, less than approximately 0.017 inches, less than approximately 0.016 inches, or less than approximately 0.015 inches. In other embodiments, the thickness of the middle portion 131 and rear portion 132 of the sole 103 can be approximately 0.014 inches, approximately 0.015 inches, approximately 0.016 inches, approximately 0.017 inches, approximately 0.018 inches, approximately 0.019 inches, approximately 0.020 inches, approximately 0.021 inches, or approximately 0.022 inches. In alternative embodiments, the middle portion 131 of the sole can be a transition region from thickest front portion 130 to the thinnest rear portion 132.

Stated another way, in many embodiments, the entire sole 103 can have a thickness less than approximately 0.030 inches. In alternative embodiments, approximately 97% of the sole can have a thickness less than approximately 0.028 inches. For comparison purposes, conventional golf club heads that maintains durability with swing speeds over 100 miles per hour have an average sole thickness of 0.030 inches over the majority of the sole.

Faceplate Features

Figure 4:
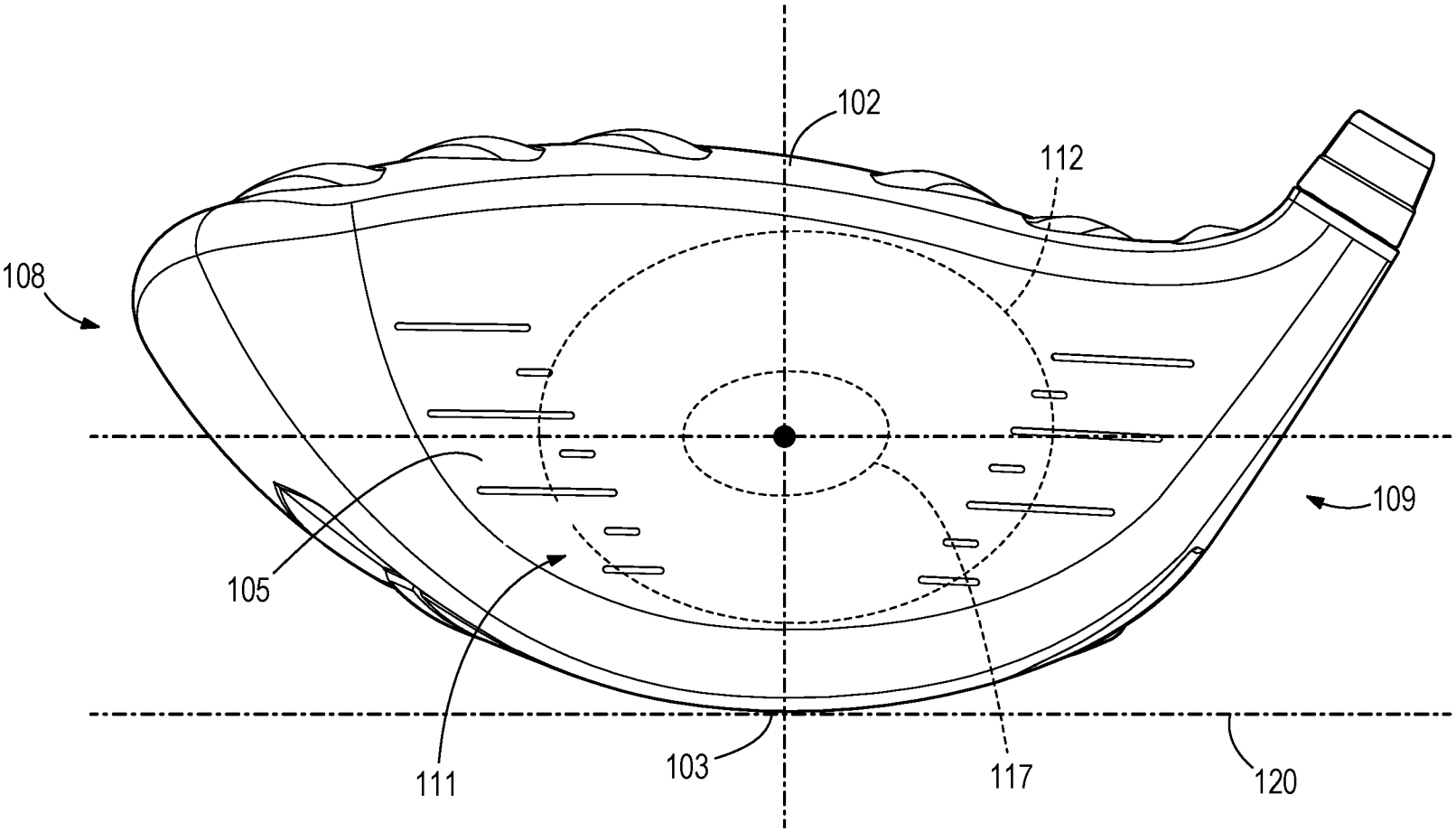
FIG. 4 illustrates an external front view of the golf club head of FIG. 1 in an address position.
Figure 5:
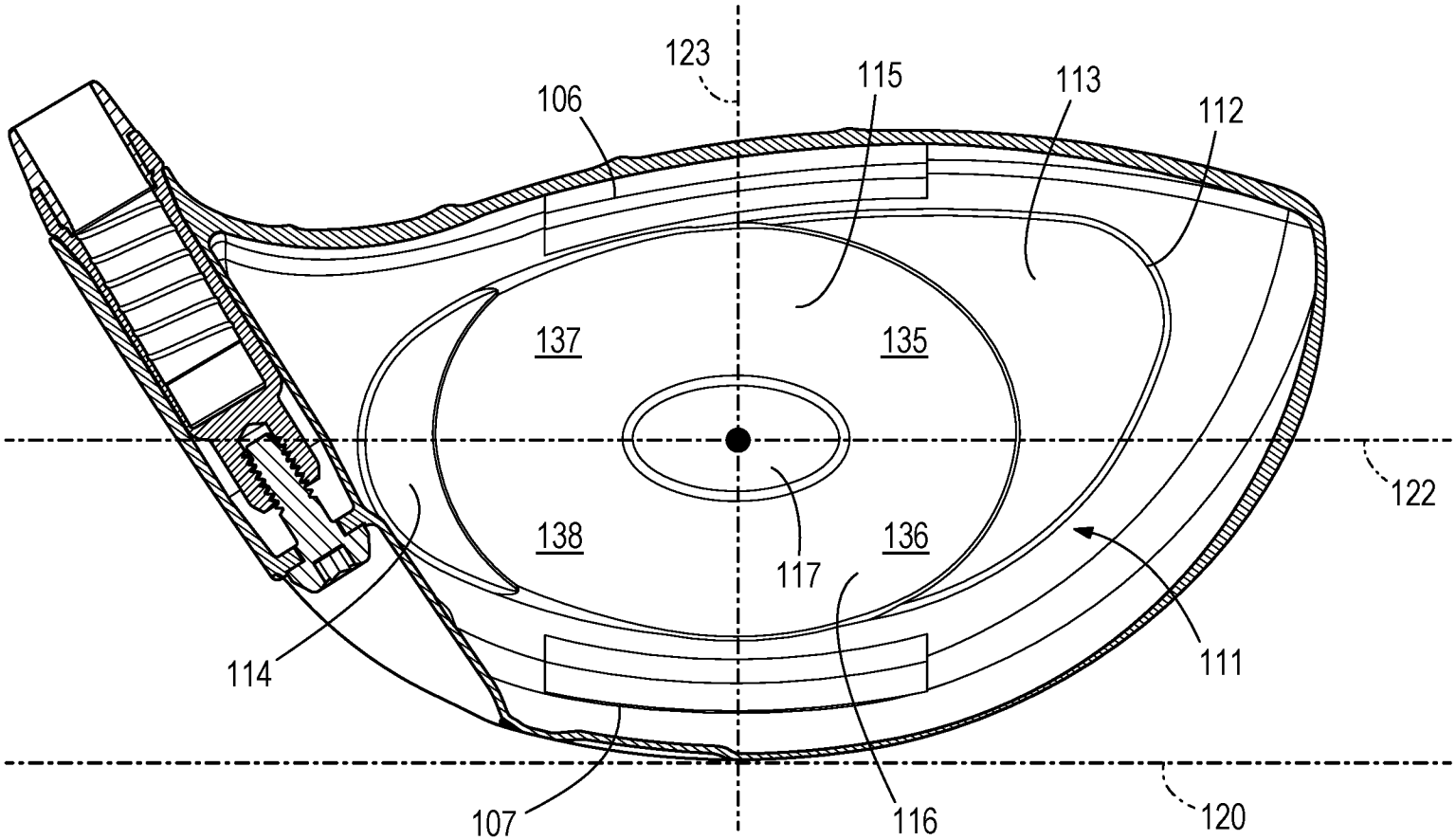
FIG. 5 illustrates a rear, internal view of the faceplate having a variable face thickness of FIG. 4 in an address position.

As shown by FIGS. 4, 5, and 6, to partially control CT across the faceplate 105 (while maintaining a thin faceplate, a thin crown 102, and a thin sole 103), the faceplate 105 can have a variable thickness profile 111, which can tune CT by allowing for thickening only in desired regions. In the illustrated embodiment, the variable thickness profile 111 of the faceplate 105 can comprise a perimeter edge region 112, a toe region 113, a heel region 114, an upper transition region 115, a lower transition region 116, and a center region 117. The thickness of the faceplate 105 is approximately 5% to 7% thinner than conventional golf club heads that must maintain durability with swing speeds over 100 miles per hour. However, only implementing a variable face thickness profile to control CT, would be insufficient due to the greater bending/flexure characteristics caused by thin faceplate and lightweight clubhead. Therefore, a crown-to-faceplate bridge and a sole-to-faceplate bridge are integrally formed within the club head to control, modify, and/or reduce the characteristic time properties (CT) of the club head.

In many embodiments, the golf club head 100 can be viewed in a perpendicular direction to an XY' plane and the faceplate 105 as shown by FIGS. 4 and 5. When viewing the golf club head 100 in a generally perpendicular direction to the XY' plane and the faceplate 105, the golf club head 100 can be defined by a coordinate system having an X' axis 122 that extends through the geometric center 121 of the faceplate 105 in a heel-to-toe direction and a Y' axis 123 that extends through the geometric center 121 in a top-to-bottom (or crown-to-sole) direction.

The X' axis 122 horizontally divides the golf club head 100 into an upper region and a lower region. The upper region of the golf club head is bounded by the X' axis 122, the crown 102, and the maximum heel-to-toe width of the club head 100. The lower region of the golf club head is bounded by the X' axis 122, the sole 103, and the maximum heel to toe width of the golf club head 100. The Y' axis 123 vertically separates the club head into a left region and a right region. The left region can be bounded by the Y' axis 123 and the toe end 108 of the golf club head 100. The right region can be bounded by the Y' axis 123 and the heel 109 of the golf club head 100. Further, the X' axis 122 and the Y' axis 123 is perpendicular to each other and form four faceplate quadrant regions.

The four faceplate quadrant regions can be defined as a center-to-high toe quadrant 135, a center-to-low toe quadrant 136, a center-to-high heel quadrant 137, and a center-to-low heel quadrant 138 when the golf club head 100 is resting on the ground plane 120 at an address position. The center-to-high toe quadrant 135 extends from the geometric center 121 and spans the upper, left faceplate region. The center-to low toe quadrant 136 extends from the geometric center 121 and spans the lower, left faceplate region. The center-to-high heel quadrant 137 extends from the geometric center 121 and spans the upper, right faceplate region. The center-to-low heel quadrant 138 extends from the geometric center 121 and spans the lower, right faceplate region.

As described above, the variable thickness 111 of the faceplate 105 can comprise a perimeter edge region 112, a toe region 113, a heel region 114, an upper transition region 115, a lower transition region 116, and a center region 117. The perimeter edge region 112 can be substantially ellipsoidal and circumscribes the toe region 113, the heel region 114, the upper transition region 115, the lower transition region 116, and the center region 117. The toe region 113 can border the perimeter edge 112, the upper transition region 115, and the lower transition region 116. The heel region 114 can border the perimeter edge 112, the upper transition region 115, and the lower transition region 116. The center region 117 is bounded by the upper 115 and lower transition region 116. In many embodiments, from the heel end of the golf club head to the center of the striking surface (or faceplate) and/or from the toe end of the golf club head to the center of the striking surface (or faceplate), the VFT can be defined as the perimeter edge 112 being the outermost region followed by the heel 114 and toe 113 portions, the upper 115 and lower transition region 116, and lastly the center region 117.

In many embodiments, the perimeter edge 112 can define the outermost region of the faceplate 105 and circumscribes the toe region 113, the heel region 114, the upper transition region 115, the lower transition region 116, and the center region 117.

Figure 8:
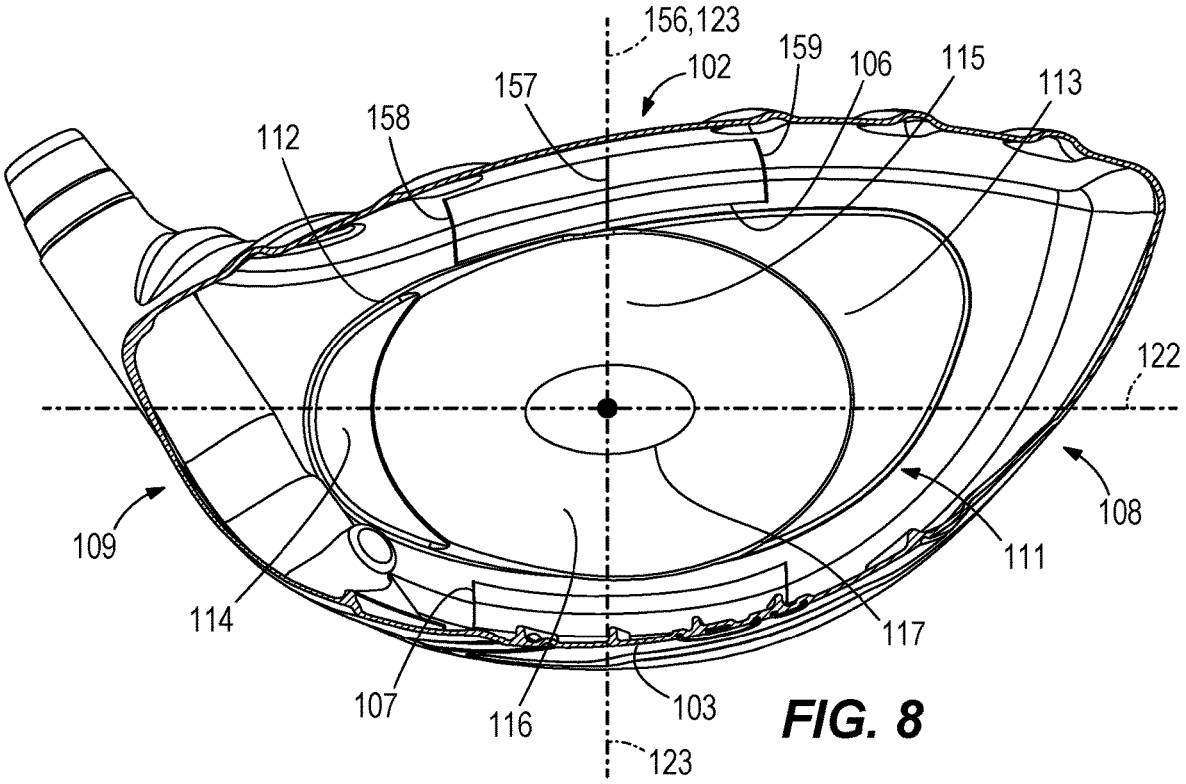
FIG. 8 illustrates a rear internal view of the golf club head of FIG. 1 with a sole-to-faceplate bridge and a crown-to-faceplate bridge.

In many embodiments, the toe region 113 of the variable face thickness 111 can span only across the center-to-low toe quadrant 136 and the center-to-high toe quadrant 135 and not into the center-to-low heel quadrant 138 and the center-to-high toe quadrant 137. In the same or an alternative embodiment, the toe region 113 can have a constant thickness. In other embodiments, the toe region 113 can have a variable thickness. The toe region 113 comprises a surface area on the back surface of the faceplate 105. As illustrated in FIG. 8, the surface area of the toe region 113 is greater than the surface area of the heel region 114.

Further, in many of the thin strike face (or faceplate 105) embodiments, it is desirable to reduce CT in the toe portion 113 of the faceplate and increase CT in the heel portion 114 of the faceplate 115. For exemplary purposes, the toe portion 113 of the variable face thickness 111 can have a greater thickness than the heel portion 114 of the variable face thickness 111. Thereby, creating a faceplate 105 this is stiffer within the toe portion 113 and more flexible within the heel portion 114 (to create a more uniform CT response across the faceplate 105).

In many embodiments, the toe portion 113 thickness of the VFT 111 can be between approximately 0.081 inches and approximately 0.087 inches. In many embodiments, the toe portion 113 thickness of the variable face thickness 111 can be between approximately 0.081 inches-approximately 0.082 inches, approximately 0.082 inches-approximately 0.083 inches, approximately 0.084 inches-approximately 0.085 inches, or approximately 0.086 inches-approximately 0.087 inches. In alternative embodiments, the toe portion 113 thickness of the VFT 111 can be approximately 0.081 inches, approximately 0.082 inches, approximately 0.083 inches, approximately 0.084 inches, approximately 0.085 inches, approximately 0.086 inches, or approximately 0.087 inches.

The heel region 114 of the variable face thickness 111 can span only across both the center-to-low heel quadrant 138 and the center-to-high heel quadrant 137 and not into the center-to-low toe quadrant 136 and the center-to-high toe quadrant 135. In many embodiments, the heel region 114 can have a constant thickness. In other embodiments, the heel region 114 can have a variable thickness 111. The heel region 114 comprises a surface area on the back surface of the faceplate 105. As illustrated in FIG. 8, the surface area of the heel region 114 is less than the surface area of the toe region 113.

As previously mentioned, to reduce CT in the toe portion of the faceplate and increase CT in the heel portion of the faceplate, the toe portion 113 of the variable face thickness can have a greater thickness than the heel portion 114. Thereby, creating a faceplate 105 that is stiffer within the toe portion 113 and more flexible within the heel portion 114 (to create a more uniform CT response across the faceplate 105).

In many embodiments, the heel portion 114 thickness of the VFT can be between approximately 0.075 inches and approximately 0.080 inches. In many embodiments, the heel portion 114 thickness of the variable face thickness 111 can be between approximately 0.075 inches-approximately 0.076 inches, approximately 0.076 inches-approximately 0.077 inches, approximately 0.077 inches-approximately 0.078 inches, approximately 0.078 inches-approximately 0.079 inches, or approximately 0.079 inches-approximately 0.080 inches. In alternative embodiments, the heel portion 114 thickness of the VFT 111 can be approximately 0.075 inches, approximately 0.076 inches, approximately 0.077 inches, approximately 0.078 inches, approximately 0.079 inches, or approximately 0.080 inches.

As further illustrated by FIG. 5, the majority of the upper-transition region 115 is bounded by at least one of the x-axis 122 (i.e. upper region), the toe portion, the heel portion, and/or the top perimeter of the faceplate. In many embodiments, the upper-transition region 115 abuts or contacts the heel portion, the toe portion, and the top of the faceplate and extends inward towards the central region 117. The upper-transition region 115 comprises a transition thickness that varies in a direction from at least the toe portion and the heel portion towards the central region. In many embodiments, the upper-transition region thickness is greater than the thickness of the heel portion and/or the toe portion.

With continued reference to FIG. 8, the majority of the lower-transition region 116 can be bounded by at least one of the x-axis 122 (i.e. lower region), the toe portion, the heel portion, and/or the bottom perimeter of the faceplate. In many embodiments, the lower-transition region 116 abuts or contacts the heel portion, the toe portion, and the bottom of the faceplate and extends inward towards the central region. The lower-transition region 116 comprises a transition thickness that varies in a direction from at least the toe portion and/or the heel portion towards the central region. In many embodiments, the lower-transition region 116 thickness is greater than the thickness of the heel portion and/or the toe portion.

In the illustrated embodiment, the central region 117 of the variable thickness profile 111 comprises an ellipse (or ellipse-like) shape. The shape of the central region defines a major axis extending in a general heel to toe direction and a minor axis extending generally in a top to bottom direction. The major axis and the minor axis intersect at a center of the central region. The major axis extends along a length of the central region, and the minor axis extends along a maximum width of the central region. In this particular embodiment, the major axis of the central region extends parallel (and/or non-angled) to the x-axis 122.

In the illustrated embodiment, the central region 117 has a thickness of 0.133 inch. In other embodiments, the thickness of the central region can vary from 0.070 to 0.25 inches. For example, in some embodiments, the thickness of the central region can be from 0.07 to 0.1, 0.09 to 0.1, 0.095 to 0.105, 0.1 to 0.12, 0.105 to 0.115, 0.11 to 0.12, 0.115 to 0.125, 0.12 to 0.13, 0.125 to 0.135, 0.13 to 0.14, 0.135 to 0.145, 0.14 to 0.15, 0.145 to 0.155, 0.15 to 0.17, 0.16 to 0.18, 0.17 to 0.2, 0.19 to 0.22, or 0.21 to 0.25 inches. In many embodiments, the central region 350 can comprise less than 5%, less than 10%, less than 15%, less than 20%, less than 25%, or less than 30% of the total surface area of the face plate 320. For example, the central region can comprise 2-10%, 5-10%, 2-15%, 5-15%, or 5-20% of the total surface area of the face plate.

In the illustrated embodiment, the center of the central region can be offset toeward from the geometric center of the face plate. In alternative embodiments, the center of the central region can be located at the geometric center of the faceplate.

The central region comprises a first side or toe side and a second side or heel side. The first side and second side of the central region are separated by the minor axis. The first side is positioned between the minor axis and the toe portion, and the second side is positioned between the minor axis and the heel portion. The length of the first side, measured along the major axis, is equivalent (or substantially similar) to the length of the second side.

In many embodiments, the combined length of the first side and the second side can be greater than approximately 0.75 inch, greater than approximately 0.80 inch, greater than approximately 0.85 inch, greater than approximately 0.90 inch, greater than approximately 0.95 inch, or greater than approximately 1.0 inch. In other embodiments, the combined length of the first side and the second side can be approximately 0.89 inch, 1.0 inch, 1.1 inches, 1.2 inches, 1.3 inches, or 1.4 inches.

In the illustrated embodiment, the central region 117 further comprises a top-side length measured along the minor axis from the center of the central region toward the top, and a bottom-side length measured along the minor axis from the center of the central region toward the bottom. In this embodiment, the top-side length and the bottom-side length are equivalent (or substantially similar) in length.

In the illustrated embodiment, the top-side length and the bottom side length are approximately 0.25 inches. In other embodiments, the top-side length and/or the bottom side length can be between 0.05 and 1.0 inches. For example, in some embodiments, the top-side length and/or the bottom side length can be between 0.05 and 0.25, 0.15 and 0.35, 0.25 and 0.45, 0.35 and 0.55, 0.45 and 0.65, 0.55 and 0.75, 0.65 and 0.85, or 0.75 and 0.1 inches.

The total mass of the faceplate 105 can be between approximately 60 and 66 grams. In many embodiments, the mass of the faceplate can be between approximately 60 grams-approximately 61 grams, approximately 61 grams-approximately 62 grams, approximately 62 grams-approximately 63 grams, approximately 63 grams-approximately 64 grams, approximately 64 grams-approximately 65 grams, or approximately 65 grams-approximately 66 grams. In further embodiments, the total mass of the face plate can be less than 66 grams, less than 65 grams, less than 64 grams, less than 63 grams, less than 62 grams, or less than 61 grams. In other embodiments, the total mass of the faceplate can be approximately 60 grams, approximately 61 grams, approximately 62 grams, approximately 63 grams, approximately 64 grams, approximately 65 grams, or approximately 66 grams. In the embodiment illustrated in FIGS. 1-7, the total mass of the faceplate 105 is 62.8 grams. For comparison, the total mass of conventional faceplates that maintains durability with swing speeds over 100 miles per hour is approximately 66.3 grams. In many embodiments, the faceplate 105 can be approximately 3 grams, approximately 4 grams, approximately 5 grams, approximately 6 grams, approximately 7 grams, approximately 8 grams, or approximately 9 grams lighter than the conventional faceplate.

Weight System of the Golf Club Head

In the illustrated embodiment, the golf club head 100 further forms a mass efficient adjustable weight system 104 designed for swing speeds under 85 miles per hour. In particular, the mass efficient adjustable weight system 104 described below only has a central weight position 140 and a heel weight position 141, and not a toe weight position (not shown). This is because golfers with swing speeds under 85 mph typically struggle with a right miss tendency, therefore introducing a heel bias weight position is unnecessary and increases the structural mass of the golf club head 100. The weight system described below offers approximately eight and ten yards of slice shot correction.

Referring to FIGS. 1, 3, 6, and 7, the golf club head forms a single slot 142 proximal the rear end 110 of the golf club 100. In many embodiments, the single slot 142 can be used as a receiving geometry for a weight assembly 143. The single slot 142 can be defined by a slot interior surface 144 that is approximately perpendicular to the sole 103. The slot interior surface 144 can be defined by a slot length 145. The single slot 142 is further defined by a slot bottom surface 146 that is perpendicular to the slot interior surface 144 and approximately parallel to the sole 103. The slot 142 is further defined by a top surface 147 that is perpendicular to the slot interior surface 144 and approximately parallel to the sole 103. In many embodiments, the slot bottom surface 146 does not extend as far towards the rear of the golf club head as the slot top surface 147. The slot further comprises at least two sidewalls at a heelward end 148 and a central portion 149 of the golf club head. The slot interior surface 144, bottom surface 146, top surface 147, and two sidewalls 148, 149 defines a channel that is open to the rear and bottom of the golf clubhead, such that when the slot 142 receives the weight assembly 143 at least a portion of the outer and lower surfaces of the weight assembly are exposed.

In the illustrated embodiment, the slot interior surface 144 can define two apertures (i.e. a central aperture (also can be referred to as a central weight position 140) and a heel side aperture (also can be referred to as a heel weight position 141). Each of the apertures comprise weight assembly attachment points within the single slot 142. In many embodiments, the central aperture 140 and the heel side aperture 141 are threaded to receive a threaded fastener 150.

In many embodiments, the golf club head 100 can further comprise a shroud 151, wherein the shroud 151 is a portion of the sole 103 of the golf club head 100 that can extend to span over the slot 142. The shroud 151 can comprise a portion or all of the bottom surface 146.

In many embodiments, the slot length 145 of the slot interior surface can vary between 2.0 inches and 4.0 inches. For example, the slot length 145 can be greater than 2.0 inches, greater than 2.5 inches, greater than 3.0 inches, or greater than 3.5 inches. The slot length of the slot interior surface 144 is no shorter than 2.0 inches.

Furthermore, the slot 144 can comprise an asymmetric shape, wherein the cross-sectional shape of the slot varies non-uniformly in a heel-to-toe direction. This asymmetric shape aids in securely fastening the weight assembly 143 within the channel defined by the slot 144. Due to the asymmetric shape of the slot 144, the weight assembly 143 is unable to slide throughout the channel. Rather, the weight assembly 143 must be removed and placed in one of the two distinct positions 140,141.

Furthermore, the slot 144 can comprise a height 152 measured from the top surface 147 of the slot to the bottom surface 146 of the slot, wherein the height 152 of the slot is the height 152 of the channel. In most embodiments, the slot 144 can comprise a variable height, wherein the height is inconsistent in the heel to toe direction. The non-uniform height of the slot 144 is imperative to the security of the weight assembly within the slot 144, since the variable height 152 of the channel enables only two weight positions to align the weight assembly with one of the heel-side aperture 141 or the central aperture 140. Due to the non-uniform height 152 of the slot 144 the weight assembly 143 is unable to slide laterally throughout the channel. Rather, the weight assembly 143 must be removed and placed in one of the two distinct positions 140,141. This prevents the golfer from being provided unlimited position choices that create confusion in determining shot shape of the golf ball and flight.

The variable height 152 of the slot 144 may vary in a range between 0.2 and 0.6 inch. The variable height 152 of the slot 144 may be 0.2 inch, 0.3 inch, 0.4 inch, 0.5 inch, or 0.6 inch.

In some embodiments, the golf club head 100 can comprise a shroud 151, such that a portion of the sole 103 of the golf club head 100 can span over the slot 144. The shroud 151 functions to increase the aerodynamics of the channel and assist in properly inserting the weight member 153 within the slot 144. The shroud 151 can have any desired geometry to cover a specific portion(s) of the slot 144 or the entire slot 144. In some embodiments, the shroud 151 can cover 5%-10% of the slot, 10%-15% of the slot, 15%-20% of the slot, 20%-25% of the slot, 25%-30% of the slot, 30%-35% of the slot, 35%-40% of the slot, 40%-45% of the slot, 45%-50% of the slot, 50%-55% of the slot, 55%-60% of the slot, 60%-65% of the slot, 65%-70% of the slot, 70%-75% of the slot, 75%-80% of the slot, 80%-85% of the slot, 85%-90% of the slot, 90%-95% of the slot, or 95%-100% of the slot. The less coverage that the shroud provides over the slot directly correlates to a lighter weight club head and vice versa.

Referring to FIGS. 1, 6, and 7, the weight assembly 143 is affixed to the golf club head 100 by threadably attaching the weight member 153 with fastener 150 (i.e. weight assembly) to one of the heel-side threaded aperture 141 or the central threaded aperture 140.

With continued reference to FIGS. 1, 6, and 7, the variable weight assembly (also referred to as the weight assembly 143) comprises a single weight member 153 and a single mechanical fastener (or fastener 150). The weight member 153 is configured to be positioned within the slot 144 of the golf club head 100. The weight member 153 comprises an outer surface, an inner surface, side walls extending between the outer surface and an interior surface, an upper surface, a lower surface, and an aperture extending through the weight member from the outer surface to the inner surface. The aperture further comprises an aperture thread on an interior portion of the aperture. The fastener 150 is retained within the weight member 153 when the weight assembly 143 is detached from the slot 144 by means of the aperture thread within the weight member aperture. The lower surface of the weight member further comprises an indent configured to receive the slot bottom surface formed by an extension of the sole. Wherein the extension of the sole comprises the shroud. The shroud provides additional stability to the weight assembly when it is threadably affixed to the slot.

Due to the limited size of the slot structure, the mass of the slot structure 144 is very small in comparison to the total mass of the golf club head 100. The mass of the slot structure 144 may be less than 10.0% of the total mass of the golf club head 100.

In many embodiments, the mass of the weight member 153 ranges between 12 grams and 18 grams. In some embodiments, the mass of the weight member 153 ranges from 12 g-13 g. 13 g-14 g, 14 g-15 g, 15.0 g-16.0 g, 16.0 g-17.0 g, or 17.0 g-18.0 g, The mass of the weight assembly 143 can be 12 g, 13 g, 14 g, 15 g, 16 g, 17 g, or 18 g, In many embodiments, the mass of the weight assembly 143 (weight member 153 and fastener 150) ranges between 12 grams and 20 grams. In some embodiments, the mass of the backweight assembly ranges from 12 g-14 g, 14 g-16 g, 16 g-18 g, or 18.0 g-20.0 g. The mass of the weight assembly can be 12 g, 13 g, 14 g, 15 g, 16 g, 17 g, 18 g, 19 g, or 20 g.

Due to the efficient placement of the weight system caused by only having a central weight position and heel weight position, and not a toe weight position along with the mass of the adjustable weight system 104, a lighter weight golf club head 100 can be achieved, while still achieving a deep club head center of gravity position 163 greater than 43 mm. The deep club head center of gravity 163 can be measured parallel to the ground plane 120, from the geometric center 121 of the faceplate 105 to the center of gravity 163 of the club head. In many embodiments, the club head center of gravity 163 can be greater than 44 mm, greater than 45 mm, greater than 46 mm, greater than 47 mm, greater than 48 mm, greater than 49 mm, or greater than 50 mm. Having a lightweight golf club head 100, while maintaining a deep club head center of gravity position 163, beneficially assist in creating a high MOI golf club head, while maintaining a high launching ball flight during the course of the flight of the golf ball.

In many embodiments, the club head 100 comprises a crown-to-sole moment of inertia $I_{xx}$ greater than approximately 2250 g·cm$^2$, greater than approximately 2500 g·cm$^2$, greater than approximately 2750 g·cm$^2$, greater than approximately 3000 g·cm$^2$, greater than approximately 3250 g·cm$^2$, greater than approximately 3500 g·cm$^2$, greater than approximately 3750 g·cm$^2$, greater than approximately 4000 g·cm$^2$, greater than approximately 4250 g·cm$^2$, greater than approximately 4500 g·cm$^2$, greater than approximately 4750 g·cm$^2$, greater than approximately 5000 g·cm$^2$, greater than approximately 5250 g·cm$^2$, greater than approximately 5500 g·cm$^2$, greater than approximately 5750 g·cm$^2$, greater than approximately 6000 g·cm$^2$, greater than approximately 6250 g·cm$^2$, greater than approximately 6500 g·cm$^2$, greater than approximately 6750 g·cm$^2$, or greater than approximately 7000 g·cm$^2$.

In many embodiments, the club head 100 comprises a heel-to-toe moment of inertia $I_{yy}$ greater than approximately 4500 g·cm$^2$, greater than approximately 4750 g·cm$^2$, greater than approximately 5000 g·cm$^2$, greater than approximately 5250 g·cm$^2$, greater than approximately 5500 g·cm$^2$, greater than approximately 5750 g·cm$^2$, greater than approximately 6000 g·cm$^2$, greater than approximately 6250 g·cm$^2$, greater than approximately 6500 g·cm$^2$, greater than approximately 6750 g·cm$^2$, or greater than approximately 7000 g·cm$^2$.

In many embodiments, the club head 100 comprises a combined moment of inertia (i.e. the sum of the crown-to-sole moment of inertia $I_{xx}$ and the heel-to-toe moment of inertia $I_{yy}$) greater than approximately 7000 g·cm$^2$, greater than approximately 7250 g·cm$^2$, greater than approximately 7500 g·cm$^2$, greater than approximately 7750 g·cm$^2$, greater than 8000 g·cm$^2$, greater than 8500 g·cm$^2$, greater than 8750 g·cm$^2$, greater than 9000 g·cm$^2$, greater than 9250 g·cm$^2$, greater than 9500 g·cm$^2$, greater than 9750 g·cm$^2$, greater than 10000 g·cm$^2$, greater than 10250 g·cm$^2$, greater than 10500 g·cm$^2$, greater than 10750 g·cm$^2$, greater than 11000 g·cm$^2$, greater than 11250 g·cm$^2$, greater than 11500 g·cm$^2$, greater than 11750 g·cm$^2$, or greater than 12000 g·cm$^2$, greater than 12500 g·cm$^2$, greater than 1300 g·cm$^2$, greater than 13500 g·cm$^2$, or greater than 14000 g·cm$^2$.

Crown-to-Faceplate Bridge

Many of the aforementioned features of the golf club head are able to be designed into a golf club head 100 because of implementing a crown-to-faceplate bridge 106. The crown-to-faceplate bridge 106 can be placed in a low stress and/or low displacement region of the clubhead 100 to locally reinforce a specific crown portion 102 and faceplate 105 portion without impacting the performance of the clubhead 100 (i.e. ball speed). Locally reinforcing a crown portion and a faceplate portion through a crown-to-faceplate bridge 106 can decrease areas of high CT properties (without increasing the entire face thickness), while having a negligible effect on impact ball speeds. In many embodiments, the crown-to-faceplate bridge 106 can mimic a gusset-like structure in strengthening/enlarging a specific portion of the transition region 118.

In many embodiments, the crown-to-faceplate bridge 106 extends from an inner surface 128 of the crown to an inner rear surface of the faceplate 105. As illustrated by FIGS. 6, 7, 8, and 9, the crown-to-faceplate bridge 106 is only present within the front portion 125 of the crown. Stated another way, the crown-to-faceplate bridge 106 is not present within the middle portion 126 or rear portion 127 of the crown 102 and exists only in the front portion of the crown 102.

With continued reference to FIGS. 6, 7, 8, and 9, the golf club head 100 further comprises a continuous transition region spanning between the sole and the crown. The continuous transition region 118 comprises a crown transition region 154 and a sole transition region 155. The crown transition region 154 can extend entirely or partially from the heel end to the toe end, spanning between the faceplate 105 and the crown 102. In many embodiments, the continuous transition region 118 surrounds the strike face entirely and disposed between the strike face and the crown. The continuous transition region 118 comprises at least one crown-to-faceplate bridge 106. The continuous transition region is curved and devoid of any sharp angles or points. In many embodiments, the radius of curvature of the continuous transition region 118 is between 0.15 inches and 0.80 inches. In some embodiments, the radius of curvature of the crown transition region 154 is between 0.30 inches and 0.80 inches. The portion of the crown-to-faceplate bridge 106 that is within the transition region 118 comprises a radius of curvature or variable radius of curvature to match that of the transition region 118.

The club head 100 can further comprise at least one crown-to-faceplate bridge 106 located near the strike face 105, entirely internally within the hollow body. The crown-to-faceplate bridge 106 is placed in locations between the heel 109 and toe 108, near to or abutting the strike face 105 to provide the strike face 105 with rigidity near regions of highest CT. In many embodiments, the strike face 105 experiences greatest CT characteristics between the mid-plane 156 and the toe end nearest the crown 102, and between the mid-plane 156 and the heel end nearest the sole 103. The crown-to-faceplate bridge 106 can be placed accordingly based on the golf club head's structure to decrease CT properties only within the necessary regions. The crown-to-faceplate bridge 106 can mimic a gusset like structure in strengthening/enlarging (or thickening) a specific portion of the transition region.

In many embodiments, the golf club head 100 can have a heel-side plane and a toe-side plane that are parallel to the mid-plane 156. For example, the heel-side plane can be located in a direction toward the heel of the golf club head 100 and away from the mid-plane 156 and the toe-side plane can be located in a direction toward the toe of the golf club head 100 and away from the mid-plane 156. In many embodiments, the heel-side plane can be located a distance of 0.55 inch to 0.80 inch from the mid-plane in a heelward direction and the toe-side plane can be located a distance of 0.55 inch to 0.80 inch from the mid-plane in a toeward direction. For example, the heel-side plane can be located a distance of 0.55 inch, 0.56 inch, 0.57 inch, 0.58 inch, 0.59 inch, 0.60 inch, 0.61 inch, 0.62 inch, 0.63 inch, 0.64 inch, 0.65 inch, 0.66 inch, 0.67 inch, 0.68 inch, 0.69 inch, 0.70 inch, 0.71 inch, 0.72 inch, 0.73 inch, 0.74 inch, 0.75 inch, 0.76 inch, 0.77 inch, 0.78 inch, 0.79 inch, or 0.80 inch from the mid-plane 156. By way of example, the toe-side plane can be located a distance of 0.55 inch, 0.56 inch, 0.57 inch, 0.58 inch, 0.59 inch, 0.60 inch, 0.61 inch, 0.62 inch, 0.63 inch, 0.64 inch, 0.65 inch, 0.66 inch, 0.67 inch, 0.68 inch, 0.69 inch, 0.70 inch, 0.71 inch, 0.72 inch, 0.73 inch, 0.74 inch, 0.75 inch, 0.76 inch, 0.77 inch, 0.78 inch, 0.79 inch, or 0.80 inch from the mid-plane. In further embodiments, the crown-to-faceplate bridge 106 can be bounded and entirely between the heel-side plane and the toe-side plane, but extending through the midplane 156.

The crown-to-faceplate bridge 106 is integral with the internal continuous transition region 118, crown 102, and/or sole 103. The crown-to-faceplate bridge 106 is devoid of weld beads, adhesives, or any other known join method.

The crown-to-faceplate bridge 106 can be used to locally thicken a specific region of the club head 100. The club head with the crown-to-faceplate bridge 106 can have mass removed from other parts of the club head 100, allowing for an optimized mass-to-volume ratio (described above) to accommodate slow swing speeds. A reduction in the mass-to-volume ratio can lead to improvements in ball speed, trajectory, and distance.

In many embodiments, the mass of the crown-to-faceplate bridge 106 can be no greater than three grams. Minimizing the weight of the crown-to-faceplate bridge 106 ensures that the above described mass/volume relationship is satisfied to improve club head characteristics, while reducing the likelihood of a golf club head having a CT value falling outside a designed threshold value. In alternative embodiments, the mass of the crown-to-faceplate bridge 106 can be between approximately 0.5 gram-approximately 1 gram, approximately 1 gram-approximately 2 grams, or approximately 2 grams-approximately 3 grams. In other embodiments, the mass of the crown-to-faceplate bridge can be approximately 0.5 grams, approximately 1 gram, approximately 2 grams, or approximately 3 grams.

Figure 9:
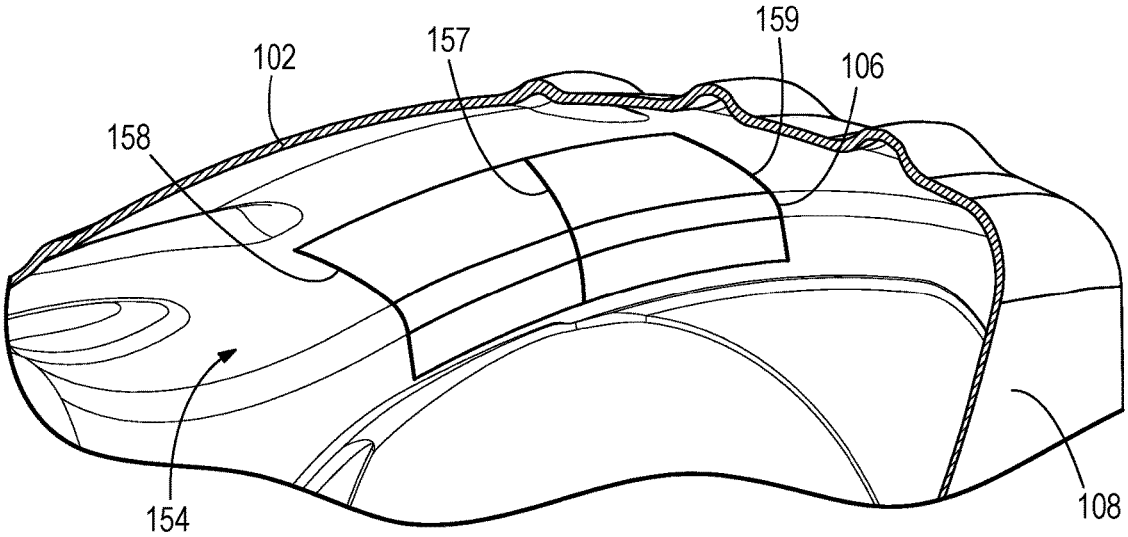
FIG. 9 illustrates a close-up view of the crown-to-faceplate bridge of FIG. 8.

In the embodiment illustrated in FIGS. 8 and 9, the golf club head 100 comprises at least one crown-to-faceplate bridge 106 that intersects and extends beyond a midplane 156 (of the golf club head) in a direction toward the heel and/or the toe of the golf club head. The midplane 156 divides the golf club head heel-to-toe width in two equal parts. The crown-to-faceplate bridge 106 can be defined by at least a length, a width, and a thickness. The crown-to-faceplate bridge length is measured in a heel-to-toe direction, perpendicular to the mid-plane 156. The crown-to-faceplate bridge width is measured in a front-to-rear direction, parallel to the mid-plane. In many embodiments, the crown-to-faceplate bridge 106 comprises a heel-to-toe center 157 that divides its length into two equal parts. In the same or another embodiment, the crown-to-faceplate bridge comprises a front-to-rear center that divides its width into two equal parts. Stated another way, at least one heel end 158 and/or toe end 159 of the crown-to-faceplate bridge 106 is partially distal to and/or spaced from the mid-plane intersection line. In alternative embodiments, the entire crown-to-faceplate bridge 106 can be located between the mid-plane 156 and the heel end or the toe end, but not intersecting the mid-plane.

In some embodiments, the crown-to-faceplate bridge 106 is aligned such that the heel-to-toe center is coplanar with the club head mid-plane 156. In other embodiments, the crown-to-faceplate bridge 106 is offset from the mid-plane 156. In some of these embodiments, the crown-to-faceplate bridge center is offset from the mid-plane by between 0.5 inch and 1.0 inch. For example, the crown-to-faceplate bridge center can be offset from the mid-plane 156 by 0.5 inch, 0.6 inch, 0.7 inch, 0.8 inch, 0.9 inch, or 1.0 inch. In other embodiments, the reinforcement region center is offset from the mid-plane by between 1.0 inch and 2.0 inches. For example, the reinforcement center can be offset from the mid-plane by 1.0 inch, 1.1 inch, 1.2 inch, 1.3 inch, 1.4 inch, 1.5 inch, 1.6 inch, 1.7 inch, 1.8 inch, 1.9 inch, or 2.0 inch.

The crown-to-faceplate bridge length does not extend entirely from heel end to toe end of the golf club head. The crown-to-faceplate bridge length extends along a portion of the heel-to-toe length of the transition region in which it lies.

In many embodiments, the crown-to-faceplate bridge length can be between 0.75 inch and 4 inches. For example, the crown-to-faceplate bridge length can be between 0.75 inch and 1 inch, 1 inch and 1.25 inches, 1.25 inches and 1.50 inches, 1.50 inches and 1.75 inches, 1.75 inches and 2 inches, 2 inches and 2.25 inches, 2.25 inches and 2.5 inches, 2.5 inches and 2.75 inches, 2.75 inches and 3 inches, 3 inches and 3.25 inches, 3.25 inches and 3.5 inches, 3.5 inches and 3.75 inches, or 3.75 inches and 4 inches. In alternative embodiments, the crown-to-faceplate bridge length can be 0.75 inch, 1.0 inch, 1.25 inches, 1.50 inches, 1.75 inches, 2.0 inches, 2.25 inches, 2.5 inches, 3.0 inches, 3.25 inches, 3.5 inches, 3.75 inches, or 4.0 inches. In some embodiments, the crown-to-faceplate bridge length can be between 15% and 85% of the length of the transition region from the heel end to the toe end.

As described above, the crown-to-faceplate bridge 106 lies at least partially within the transition region 118. In some embodiments, the crown-to-faceplate bridge width extends across the entire transition region front-to-rear width. In some embodiments, the crown-to-faceplate bridge width extends across only a portion of the transition region front-to-rear width. In some of these embodiments and others, the crown-to-faceplate bridge width extends beyond the transition region and onto either the crown or the sole. The crown-to-faceplate bridge width can be between 50% and 100% of the transition region width. In some embodiments wherein the crown-to-faceplate bridge extends beyond the transition region, the crown-to-faceplate bridge width can be greater than the transition region width. In these embodiments, the crown-to-faceplate bridge width can be up to 150% of crown-to-faceplate bridge width.

The crown-to-faceplate bridge width does not extend entirely from the faceplate 105 to rear of the golf club head. In many embodiments, the crown-to-faceplate bridge width can be between 0.40 inch and 0.80 inches. For example, the crown-to-faceplate bridge width can be between 0.40 inch and 0.50 inch, 0.50 inch and 0.6 inches, 0.6 inches and 0.7 inches, or 0.7 inches and 0.80 inches. In some embodiments, the crown-to-faceplate bridge width can be approximately 0.40 inch, approximately 0.45 inch, approximately 0.50 inch, approximately 0.55 inch, approximately 0.60 inch, approximately 0.65 inch, approximately 0.70 inch, approximately 0.75 inch, or approximately 0.80 inch.

In many embodiments, the crown-to-faceplate bridge 106 is integrally formed with at least the portion of the club head which it contacts (i.e. devoid of weld beads, adhesives, etc). Stated another way, the crown-to-faceplate bridge 106, the transition region, and the portion of the crown which the crown-to-faceplate bridge 106 is coupled to comprise the same material or combination of materials.

In many embodiments, the crown-to-faceplate bridge 106 has a generally projected rectangular shape when viewed from a top plane. In other embodiments, the crown-to-faceplate bridge 106 can have one of the following shapes: oval, circle, trapezoidal, rounded rectangle, square, rounded square, or another polygon. In many embodiments, the crown-to-faceplate bridge 106 is substantially parallel with respect to its length. In many embodiments, the crown-to-faceplate bridge 106 is substantially parallel with respect to its width.

The crown-to-faceplate bridge 106 can have a variable or constant thickness across the width and/or length. In some of these embodiments, the crown-to-faceplate bridge 106 comprises a non-tapered, constant thickness across both of its width and length. In other embodiments, the crown-to-faceplate bridge 106 comprises a constant thickness across only one of the width or length, and a variable (or tapered) thickness across the other of the width or length.

In many embodiments, the crown-to-faceplate bridge 106 is thickest at its center. In these embodiments, the crown-to-faceplate bridge thickness tapers circumferentially (or radially) from the center and the center of the reinforcement region comprises a rounded or pointed peak. In other words, the crown-to-faceplate bridge thickness reduces linearly or curvedly away from the center (of both the width and the length) in all directions. The taper rate will vary in some directions relative to others based on the crown-to-faceplate bridge dimensions, such that the crown-to-faceplate bridge thickness is the same at all edges of the crown-to-faceplate bridge. The thickness can taper linearly, curvedly, or in a stepped formation toward its edges in a direction away from the center and toward the front, rear, heel end, and toe end. The front, rear, heel end 158, and toe end 159 edges of the crown-to-faceplate bridge are tapered such that they transition substantially seamlessly with the surrounding golf club head. In other words, the thickness of the crown-to-faceplate bridge reduces to that of the surrounding golf club head at its perimeter edges so as to prevent the existence of a substantial lip or step that differentiates the reinforcement region from the surrounding club head.

In some embodiments, the crown-to-faceplate bridge front-to-rear cross-sectional shape differs from the crown-to-faceplate bridge heel-to-toe cross-sectional shape. In others of these embodiments, the crown-to-faceplate bridge front-to-rear cross-sectional shape is similar to the crown-to-faceplate bridge heel-to-toe cross-sectional shape. In some embodiments, the reinforcement region comprises a slightly curved cross-sectional shape.

Sole-to-Faceplate Bridge

Many of the aforementioned features of the golf club head 100 are able to be designed into a golf club head 100 because of implementing at least one sole-to-faceplate bridge 107. The sole-to-faceplate bridge 107 can be placed in a low stress and/or low displacement region of the clubhead to locally reinforce a specific sole portion 103 and faceplate portion without impacting the performance of the clubhead (i.e. ball speed). Locally reinforcing a sole portion and a faceplate portion through a sole-to-faceplate bridge 107 can decrease areas of high CT characteristics (without increasing the entire face thickness), while having a negligible effect on impact ball speeds. In many embodiments, the crown-to-faceplate bridge 107 can mimic a gusset like structure in strengthening/enlarging a specific portion of the club head.

Figure 10:
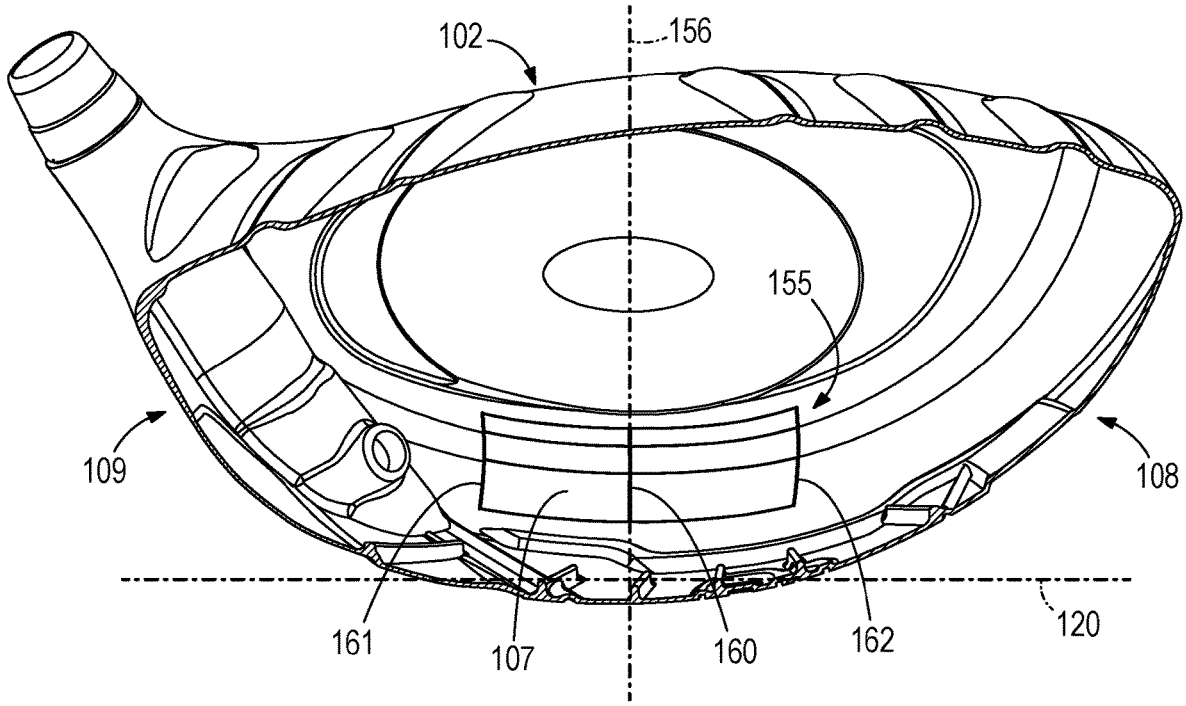
FIG. 10 illustrates a rear, internal view of the golf club head of FIG. 1 with a sole-to-faceplate bridge.
Figure 11:
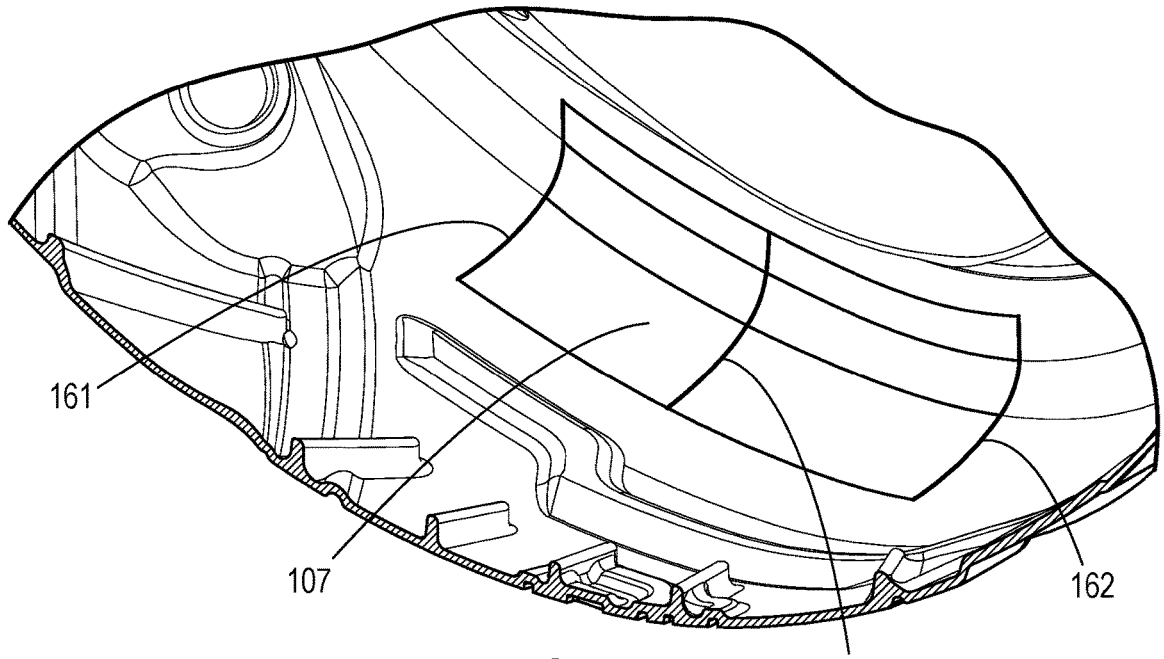
FIG. 11 illustrates a close-up view of the sole-to-faceplate bridge of FIG. 10.

In many embodiments, the sole-to-faceplate bridge 107 extends from an inner surface 133 of the sole to an inner rear surface of the faceplate 105. As illustrated by FIGS. 10 and 11, the sole-to-faceplate bridge 107 is only present within the front portion of the sole 103. Stated another way, the sole-to-faceplate bridge 107 is not present within the middle portion 131 or rear portion 132 of the sole 103 and exists only in the front portion 130 of the sole 103.

As described above, the golf club head 100 further comprises a continuous transition region spanning 118 between the sole 103 and the crown 102. The continuous transition region 118 comprises a crown transition region 154 and a sole transition region 155. The sole transition region 155 can extend entirely or partially from the heel end to the toe end, spanning between the faceplate 105 and the sole 103. In many embodiments, the continuous transition region 118 surrounds the strike face 105 entirely and disposed between the strike face 105 and the sole 103. The continuous transition region 118 comprises at least one sole-to-faceplate bridge 107. The continuous transition region 118 is curved and devoid of any sharp angles or points. In many embodiments, the radius of curvature of the continuous transition region 118 is between 0.15 inches and 0.80 inches. In many embodiments, the radius of curvature of the continuous transition region 118 is approximately 0.15 inch, 0.16 inch, 0.17 inch, 0.18 inch, 0.19 inch, 0.20 inch, 0.21 inch, 0.22 inch, 0.23 inch, 0.24 inch, 0.25 inch, 0.26 inch, 0.27 inch, 0.28 inch, 0.29 inch, 0.30 inch, 0.31 inch, 0.32 inch, 0.33 inch, 0.34 inch, 0.35 inch, 0.36 inch, 0.37 inch, 0.38 inch, 0.39 inch, 0.40 inch, 0.41 inch, 0.42 inch, 0.43 inch, 0.44 inch, 0.45 inch, 0.46 inch, 0.47 inch, 0.48 inch, 0.49 inch, 0.50 inch, 0.51 inch, 0.52 inch, 0.53 inch, 0.54 inch, 0.55 inch, 0.56 inch, 0.57 inch, 0.58 inch, 0.59 inch, 0.60 inch, 0.61 inch, 0.62 inch, 0.63 inch, 0.64 inch, 0.65 inch, 0.66 inch, 0.67 inch, 0.68 inch, 0.69 inch, 0.70 inch, 0.71 inch, 0.72 inch, 0.73 inch, 0.74 inch, 0.75 inch, 0.76 inch, 0.77 inch, 0.78 inch, 0.79 inch, or 0.80 inch. In some embodiments, the radius of curvature of the sole transition region 155 is between 0.30 inches and 0.80 inches. In many embodiments, the radius of curvature of the sole transition region 155 is approximately 0.30 inch, 0.31 inch, 0.32 inch, 0.33 inch, 0.34 inch, 0.35 inch, 0.36 inch, 0.37 inch, 0.38 inch, 0.39 inch, 0.40 inch, 0.41 inch, 0.42 inch, 0.43 inch, 0.44 inch, 0.45 inch, 0.46 inch, 0.47 inch, 0.48 inch, 0.49 inch, 0.50 inch, 0.51 inch, 0.52 inch, 0.53 inch, 0.54 inch, 0.55 inch, 0.56 inch, 0.57 inch, 0.58 inch, 0.59 inch, 0.60 inch, 0.61 inch, 0.62 inch, 0.63 inch, 0.64 inch, 0.65 inch, 0.66 inch, 0.67 inch, 0.68 inch, 0.69 inch, 0.70 inch, 0.71 inch, 0.72 inch, 0.73 inch, 0.74 inch, 0.75 inch, 0.76 inch, 0.77 inch, 0.78 inch, 0.79 inch, or 0.80 inch. The portion of the sole-to-faceplate bridge 107 that is within the continuous transition region 118 comprises a radius of curvature or variable radius of curvature to match that of the transition region 118.

The club head 100 can further comprise at least one sole-to-faceplate bridge 107 located near the strike face 105, internally within the hollow body. The sole-to-faceplate bridge 107 is placed in locations between the heel and toe, near to or abutting the strike face 105 to provide the strike face 105 with rigidity near regions of highest CT In many embodiments, the strike face 105 experiences greatest CT characteristics between the mid-plane 156 and the toe end nearest the sole 103, and between the mid-plane 156 and the heel end nearest the sole 103. The sole-to-faceplate bridge 107 are placed accordingly based on the golf club head's structure to decrease CT properties only within the necessary regions.

In many embodiments, the golf club head 100 can have a heel-side plane and a toe-side plane that are parallel to the mid-plane 156. For example, the heel-side plane can be located in a direction toward the heel of the golf club head 100 and away from the mid-plane 156 and the toe-side plane can be located in a direction toward the toe of the golf club head 100 and away from the mid-plane 156. In many embodiments, the heel-side plane can be located a distance of 0.55 inch to 0.80 inch from the mid-plane in a heelward direction and the toe-side plane can be located a distance of 0.55 inch to 0.80 inch from the mid-plane in a toeward direction. For example, the heel-side plane and/or the toe-side plane can be located a distance of 0.55 inch, 0.56 inch, 0.57 inch, 0.58 inch, 0.59 inch, 0.60 inch, 0.61 inch, 0.62 inch, 0.63 inch, 0.64 inch, 0.65 inch, 0.66 inch, 0.67 inch, 0.68 inch, 0.69 inch, 0.70 inch, 0.71 inch, 0.72 inch, 0.73 inch, 0.74 inch, 0.75 inch, 0.76 inch, 0.77 inch, 0.78 inch, 0.79 inch, or 0.80 inch from the mid-plane 156. In further embodiments, the sole-to-faceplate bridge 107 can be bounded and between the heel-side plane and the toe-side plane, but extending through the midplane 156.

In many embodiments, the sole-to-faceplate bridge 107 is integrally formed with at least the portion of the club head which it contacts (i.e. devoid of weld beads, adhesives, etc). Stated another way, the sole-to-faceplate bridge 107, the transition region, and the portion of the sole which the sole-to-faceplate bridge 107 is coupled to comprises the same material or combination of materials.

The sole-to-faceplate bridge 107 can be used to locally thicken the club head. The club head with the sole-to-faceplate bridge 107 can have mass removed from other parts of the club head 100, allowing for an optimized mass-to-volume ratio to accommodate slow swing speeds. A reduction in the mass-to-volume ratio can lead to improvements in ball speed, trajectory, and distance.

In many embodiments, the mass of the sole-to-faceplate bridge 107 can be no greater than three grams. Minimizing the weight of the sole-to-faceplate bridge 107 ensures that above described mass/volume relationship is satisfied to improve club head characteristics, while reducing the likelihood of a golf club head having a CT value falling outside a designed threshold value. In alternative embodiments, the mass of the sole-to-faceplate bridge 107 can be between approximately 0.5 gram-approximately 1 gram, approximately 1 gram-approximately 2 grams, or approximately 2 grams-approximately 3 grams. In other embodiments, the mass of the sole-to-faceplate bridge can be approximately 0.5 grams, approximately 1 gram, approximately 2 grams, or approximately 3 grams.

In the embodiment illustrated in FIGS. 10 and 11, the golf club head 100 comprises at least one sole-to-faceplate bridge 107 that intersects and extends beyond the midplane 156 in a direction toward the heel and/or the toe of the golf club head. The sole-to-faceplate bridge 107 can be defined by at least a length, a width, and a thickness. The sole-to-faceplate bridge length is measured in a heel-to-toe direction, perpendicular to the mid-plane 156. The sole-to-faceplate bridge width is measured in a front-to-rear direction, parallel to the mid-plane. In many embodiments, the sole-to-faceplate bridge 107 comprises a heel-to-toe center that divides its length into two equal parts. In the same or another embodiment, the sole-to-faceplate bridge 107 comprises a front-to-rear center that divides its width into two equal parts. Stated another way, at least one end of the sole-to-faceplate bridge is partially distal to the mid-plane 156 intersection line. In alternative embodiments, the entire sole-to-faceplate bridge can be located between the mid-plane and the heel end or the toe end, but not intersecting the mid-plane.

In some embodiments, the sole-to-faceplate bridge 107 is aligned such that the heel-to-toe center 160 is coplanar with the club head mid-plane 156. In other embodiments, the sole-to-faceplate bridge 107 is offset from the mid-plane 156. In some of these embodiments, the sole-to-faceplate bridge center is offset from the mid-plane 156 by between 0.5 inch and 1.0 inch. In other embodiments, the sole-to-faceplate bridge center is offset from the mid-plane by between 1.0 inch and 2.0 inches.

The sole-to-faceplate bridge length does not extend entirely from heel end to toe end. The sole-to-faceplate bridge length extends along a portion of the heel-to-toe length of the transition region in which it lies. In many embodiments, the sole-to-faceplate bridge length can be between 0.75 inch and 4 inches. For example, the sole-to-faceplate bridge length can be between 0.75 inch and 1 inch, 1 inch and 1.25 inches, 1.25 inches and 1.50 inches, 1.50 inches and 1.75 inches, 1.75 inches and 2 inches, 2 inches and 2.25 inches, 2.25 inches and 2.5 inches, 2.5 inches and 2.75 inches, 2.75 inches and 3 inches, 3 inches and 3.25 inches, 3.25 inches and 3.5 inches, 3.5 inches and 3.75 inches, or 3.75 inches and 4 inches. In some embodiments, the sole-to-faceplate bridge length can be between 15% and 85% of the length of the transition region from the heel end to the toe end.

As described above, the sole-to-faceplate bridge 107 lies at least partially within the transition region 118. In some embodiments, the sole-to-faceplate bridge width extends across the entire transition region front-to-rear width. In some embodiments, the sole-to-faceplate bridge width extends across only a portion of the transition region front-to-rear width. In some of these embodiments and others, the sole-to-faceplate bridge width extends beyond the transition region 118 and onto the sole 103. The sole-to-faceplate bridge width can be between 50% and 100% of the transition region width. In some embodiments wherein the sole-to-faceplate bridge extends beyond the transition region, the sole-to-faceplate bridge width can be greater than the transition region width. In these embodiments, the sole-to-faceplate bridge width can be up to 150% of sole-to-faceplate bridge width.

The sole-to-faceplate bridge width does not extend entirely from the faceplate 105 to rear of the golf club head 100. In many embodiments, the sole-to-faceplate bridge width can be between 0.40 inch and 0.80 inches. For example, the sole-to-faceplate bridge width can be between approximately 0.40 inch and approximately 0.50 inch, approximately 0.50 inch and approximately 0.6 inches, approximately 0.6 inches and approximately 0.7 inches, or approximately 0.7 inches and approximately 0.80 inches. In other embodiments, the sole-to-faceplate bridge width can be approximately 0.40 inch, approximately 0.45 inch, approximately 0.50 inch, approximately 0.55 inch, approximately 0.60 inch, approximately 0.65 inch, approximately 0.70 inch, approximately 0.75 inch, or approximately 0.80 inch.

In many embodiments, the sole-to-faceplate bridge is integrally formed with at least the portion of the club head which it contacts. The sole-to-faceplate bridge, the transition region, and the portion of the sole which the sole-to-faceplate bridge lies comprise the same material or combination of materials.

In many embodiments, the sole-to-faceplate bridge 107 has a generally projected rectangular shape when viewed from a top plane. In other embodiments, the sole-to-faceplate bridge 107 can have one of the following shapes: oval, circle, trapezoidal, rounded rectangle, square, rounded square, or another polygon. In many embodiments, the sole-to-faceplate bridge 107 is substantially parallel with respect to its length. In many embodiments, the sole-to-faceplate bridge 107 is substantially parallel with respect to its width.

The sole-to-faceplate bridge 107 can have a variable or constant thickness across the width and/or length. In some of these embodiments, the sole-to-faceplate bridge 107 comprises a non-tapered, constant thickness across both of its width and length. In other embodiments, the sole-to-faceplate bridge 107 comprises a constant thickness across only one of the width or length, and a variable (or tapered) thickness across the other of the width or length.

In many embodiments, the sole-to-faceplate bridge 107 is thickest at its center. In these embodiments, the sole-to-faceplate bridge thickness tapers circumferentially (or radially) from the center and the center of the reinforcement region comprises a rounded or pointed peak. In other words, the sole-to-faceplate bridge 107 thickness reduces linearly or curvedly away from the center (of both the width and the length) in all directions. The taper rate will vary in some directions relative to others based on the sole-to-faceplate bridge dimensions, such that the sole-to-faceplate bridge thickness is the same at all edges of the sole-to-faceplate bridge. The thickness tapers linearly, curvedly, or in a stepped formation toward its edges in a direction away from the center and toward the front, rear, heel end, and toe end. The front, rear, heel end 161, and toe end 162 edges of the sole-to-faceplate bridge are tapered such that they transition substantially seamlessly with the surrounding golf club head. In other words, the thickness of the sole-to-faceplate bridge 107 reduces to that of the surrounding golf club head at its edges so as to prevent the existence of a substantial lip or step that differentiates the sole-to-faceplate bridge from the surrounding club head.

In some embodiments, the sole-to-faceplate bridge front-to-rear cross-sectional shape differs from the sole-to-faceplate bridge heel-to-toe cross-sectional shape. In others of these embodiments, the sole-to-faceplate bridge front-to-rear cross-sectional shape is similar to the sole-to-faceplate bridge heel-to-toe cross-sectional shape. In some embodiments, the sole-to-faceplate bridge comprises a slightly curved cross-sectional shape.

Example 1

A two-club player test experiment was conducted to analyze the effectiveness of the golf club head embodiment of FIGS. 1-11 to obtain quantifiable information with regards to ball speed, launch angle, and spin rate properties. Specifically, the embodiment of FIGS. 1-11 was benchmarked against a control club that maintains durability with swing speeds over 100 miles per hours.

The two-club player test procedure was conducted across twenty-two golfers with each golfer hitting a total of twenty shots. Each player would hit five shots with the experimental club head and then five shots with the control club and rotate until a total of twenty shots were taken. After each swing, the ball speed, launch angle, and spin rate properties was recorded and logged.

The tested golf club head (or experimental club) of FIGS. 1-11 was a driver-type golf club head with a loft angle of approximately 10.5 degrees, a swing weight of C8, a head weight of 191.1 grams, and a head volume of 460 cc. The control club was a driver-type golf club head with a loft angle of approximately 10.5 degrees, a swing weight of D3.0, a head weight of 201 grams, and a volume of 460 cc.

Typically, with all things being equal (i.e. same swing speed, etc.), a decrease in the mass of the clubhead results in decreased ball speeds, because the amount of momentum possessed by a moving object (i.e. a golf ball) is the product of the mass of the golf club head and the velocity of the golf club head. Therefore, typically increasing the mass of a clubhead colliding with a golf ball generates greater ball speeds. However, this was not the case. Specifically, the experimental club weighed 8.1 grams lighter but produced 0.5% greater ball speeds over the control club, while achieving similar launch angles. Therefore, it was concluded that the increased flexure of the golf club head caused by thinning many of the club head structural elements described above can outperform and/or match performance gains typically associated with heavier weighted golf clubs. This is particularly important as an increase in distance can compensate strokes lost by an increase in a player's dispersion.

Example 2

An FEA experiment was conducted to analyze the effectiveness of the golf club head embodiments described herein to obtain quantifiable information with regards to the change in CT, ball speed loss, and added mass to the clubhead by implementing one or more of a crown-to-faceplate bridge or a sole-to-faceplate bridge. Specifically, the positioning of the crown-to-faceplate bridge and/or the sole-to-faceplate bridge illustrated by FIGS. 8-11 were simulated individually and together to determine the effectiveness of each feature individually (and together) with respect to the change in club head CT, ball speed loss, and the added structural mass to the club head. The control club is the golf club head of FIGS. 1-11 with a thin crown, a thin sole, a thin faceplate, and a mass efficient weight system without a crown-to-faceplate bridge nor a sole-to-faceplate bridge.

The FEA experiment was a virtual study ran to simulate the physical USGA CT test. In the virtual FEA experiment, a steel hammer is impacted at three specified speeds determined by the USGA test protocols. During impact, the rigid body acceleration and the rigid body velocity of the hammer is plotted. After, the data from all three impacts are collected and plotted on a new curve, the Y-axis intercept is the calculated CT values.

The only differences between the tested golf club heads and the control club is the addition of either one or both of a crown-to-faceplate bridge or a sole-to-faceplate bridge. The first simulated golf club head included only a sole-to-faceplate bridge that weighed approximately one gram and devoid of a crown-to-faceplate bridge. This first simulated golf club head reduced CT by 2.7 microseconds and decreased ball speeds by approximately 0.3 miles per hour compared to the control club. The second simulated golf club head included only a sole-to-faceplate bridge that weighed approximately two grams and devoid of a crown-to-faceplate bridge. The second simulated golf club head reduced CT by 12.5 microseconds and decreased ball speeds by approximately 0.5 miles per hour compared to the control club. The third simulated golf club head included only a crown-to-faceplate bridge that weighed approximately two grams and devoid of a sole-to-faceplate bridge. This third simulated golf club head reduced CT by 12.3 microseconds and decreased ball speeds by approximately 0.33 miles per hour compared to the control club. The fourth simulated golf club head included both a sole-to-faceplate bridge that weighed approximately one gram and a crown-to-faceplate bridge that weighed approximately one gram. This fourth simulated golf club head reduced CT by 6.6 microseconds and decreased ball speeds by approximately 0.51 miles per hour compared to the control club. These results illustrate the effectiveness of controlling CT across the faceplate (with a crown-to-faceplate bridge and/or a sole-to-faceplate bridge) without increasing the perimeter thickness of the faceplate, while minimizing added mass to the clubhead to maintain a lightweight club head.

Clause 1. A hollow golf club head comprising: a crown, a sole, a strike face, a toe end, a heel end, and a rear; wherein the crown, sole, strike face, and rear combine to form an interior cavity; wherein the strike face is opposite the rear, and adjacent the crown and the sole; wherein the sole is resting on a ground plane when the club head is at an address position; wherein the toe end is opposite the heel end, and the sole is opposite the crown; and wherein the strike face further comprises a geometric center point and a mid-plane extending through the geometric center point in a direction from the strike face to rear of the golf club head; wherein the mid-plane is perpendicular to the ground plane; wherein the golf club head further comprises a crown transition region and a sole transition region; wherein the crown transition region is formed between the strike face and the crown; wherein the sole transition region is formed between the strike face and the sole; wherein the crown transition region comprises a first transition region thickness; wherein the sole transition region comprises a second transition region thickness; wherein the golf club head further comprises a crown-to-faceplate bridge and a sole-to-faceplate bridge; wherein the crown-to-faceplate bridge is located entirely within the crown transition region and the sole-to-faceplate bridge is located within the sole transition region; wherein the crown-to-faceplate bridge comprises a first reinforcement region thickness; and the sole-to-faceplate bridge comprises a second reinforcement region thickness; wherein the first reinforcement region thickness is greater than the crown transition region thickness; and the second reinforcement region thickness is greater than the sole transition region thickness.

Clause 2. The hollow golf club head of clause 1, wherein the crown-to-faceplate bridge further comprises a first reinforcement region width measured in a heel-to-toe direction and a first reinforcement region length measured in a front-to-rear direction; and the sole-to-faceplate bridge further comprises a second reinforcement region width measured in a heel-to-toe direction and a second reinforcement region length measured in a front-to-rear direction; wherein the first reinforcement region width varies along the first reinforcement region length; and the second reinforcement region width varies along the second reinforcement region length.

Clause 3. The hollow golf club head of clause 2, wherein the first reinforcement region length varies along the first reinforcement region width; and the second reinforcement region length varies along the second reinforcement region width.

Clause 4. The hollow golf club head of clause 2, further comprising a heel-side plane and a toe-side plane; wherein the heel-side plane and the toe-side plane are parallel to the mid-plane; and wherein the heel-side plane is located in a direction toward the heel end of the golf club head and spaced from the mid-plane and the toe-side plane is located in a direction toward the toe end of the golf club and spaced from the mid-plane; wherein the heel-side plane is located a distance of 0.55" to 0.80" from the mid-plane; and the toe-side plane is located a distance of 0.75" to 0.80" from the mid-plane; and wherein the first reinforcement region width and the second reinforcement region width are bounded by and between the heel-side plane and the toe-side plane.

Clause 5. The hollow golf club head of clause 1, wherein the crown-to-faceplate bridge is integrally formed within the crown transition region and the sole-to-faceplate bridge is integrally formed within the sole transition region.

Clause 6. The hollow golf club head of clause 1, further comprising a first intersection point defined by the intersection of the mid-plane with the crown-to-faceplate bridge and a second intersection point defined by the intersection of the mid-plane with the sole-to-faceplate bridge; wherein the crown-to-faceplate bridge contacts the first intersection point and extends beyond the first intersection point in both a heel and a toe direction; and the sole-to-faceplate bridge contacts the second intersection point and extends beyond the second intersection point in both the heel and the toe direction.

Clause 7. The hollow golf club head of clause 6, wherein the mass of the club head is approximately 194 grams and the volume of the club head is approximately 460 cc, such that a club head mass-to-volume ratio is between 0.40 and 0.44

Clause 8. The hollow golf club head of clause 7, wherein the club head center of gravity is greater than 43 mm, measured from the geometric center point of the strike face and parallel to the ground plane.

Clause 9. The hollow golf club head of clause 8, wherein the rear portion of the golf club head further comprises a single slot; wherein the single slot defines: a slot interior surface, a slot bottom surface, a slot top surface, and two slot sidewalls; wherein the slot interior surface, slot bottom surface, slot top surface, and two slot sidewalls cooperate to form a slot channel opening to the exterior rear and sole of the golf club head; wherein the slot interior surface further comprises only a central weight position and a heel weight position and devoid of a toe weight position wherein the central weight position and the heel weight position comprise weight assembly attachment points; wherein the golf club head further comprises a moveable weight assembly; and wherein the weight assembly is only detachably affixed to one of the central weight position and the heel weight position.

Clause 10. A hollow golf club head comprising: a crown, a sole, a strike face, a toe end, a heel end, and a rear; wherein the crown, sole, strike face, and rear combine to form an interior cavity; wherein the strike face is opposite the rear, and adjacent the crown and the sole; wherein the sole is resting on a ground plane when the club head is at an address position; wherein the toe end is opposite the heel end, and the sole is opposite the crown; and wherein the strike face further comprises a geometric center point and a mid-plane extending through the geometric center point in a direction from the strike face to rear of the golf club head; wherein the mass of the strike face is less than 63 grams; wherein the mid-plane is perpendicular to the ground plane; wherein the golf club head further comprises a crown transition region and a sole transition region; wherein the crown transition region is formed between the strike face and the crown; wherein the sole transition region is formed between the strike face and the sole; wherein the crown transition region comprises a first transition region thickness; wherein the sole transition region comprises a second transition region thickness; wherein the golf club head further comprises a crown-to-faceplate bridge and a sole-to-faceplate bridge; wherein the crown-to-faceplate bridge is located entirely within the crown transition region and the sole-to-faceplate bridge is located within the sole transition region; wherein the crown-to-faceplate bridge comprises a first reinforcement region thickness; and the sole-to-faceplate bridge comprises a second reinforcement region thickness; wherein the first reinforcement region thickness is greater than the crown transition region thickness; and the second reinforcement region thickness is greater than the sole transition region thickness.

Clause 11. The hollow golf club head of clause 10, wherein the crown-to-faceplate bridge further comprises a first reinforcement region width measured in a heel-to-toe direction and a first reinforcement region length measured in a front-to-rear direction; and the sole-to-faceplate bridge further comprises a second reinforcement region width measured in a heel-to-toe direction and a second reinforcement region length measured in a front-to-rear direction; wherein the first reinforcement region width varies along the first reinforcement region length; and the second reinforcement region width varies along the second reinforcement region length.

Clause 12. The hollow golf club head of clause 11, wherein the first reinforcement region length varies along the first reinforcement region width; and the second reinforcement region length varies along the second reinforcement region width.

Clause 13. The hollow golf club head of clause 11, further comprising a heel-side plane and a toe-side plane; wherein the heel-side plane and the toe-side plane are parallel to the mid-plane; and wherein the heel-side plane is located in a direction toward the heel end of the golf club head and spaced from the mid-plane and the toe-side plane is located in a direction toward the toe end of the golf club and spaced from the mid-plane; wherein the heel-side plane is located a distance of 0.55" to 0.80" from the mid-plane; and the toe-side plane is located a distance of 0.75" to 0.80" from the mid-plane; and wherein the first reinforcement region width and the second reinforcement region width are bounded by and between the heel-side plane and the toe-side plane.

Clause 14. The hollow golf club head of clause 10, wherein the crown-to-faceplate bridge is integrally formed within the crown transition region and the sole-to-faceplate bridge is integrally formed within the sole transition region.

Clause 15. The hollow golf club head of clause 10, further comprising a first intersection point defined by the intersection of the mid-plane with the crown-to-faceplate bridge and a second intersection point defined by the intersection of the mid-plane with the sole-to-faceplate bridge; wherein the crown-to-faceplate bridge contacts the first intersection point and extends beyond the first intersection point in both a heel and a toe direction; and the sole-to-faceplate bridge contacts the second intersection point and extends beyond the second intersection point in both the heel and the toe direction.

Clause 16. The hollow golf club head of clause 15, wherein the mass of the club head is approximately 194 grams and the volume of the club head is approximately 460 cc, such that a club head mass-to-volume ratio is between 0.40 and 0.44

Clause 17. The hollow golf club head of clause 16, wherein the club head center of gravity is greater than 43 mm, measured from the geometric center point of the strike face and parallel to the ground plane.

Clause 18. The hollow golf club head of clause 17, wherein the rear portion of the golf club head further comprises a single slot; wherein the single slot defines: a slot interior surface, a slot bottom surface, a slot top surface, and two slot sidewalls; wherein the slot interior surface, slot bottom surface, slot top surface, and two slot sidewalk cooperate to form a slot channel opening to the exterior rear and sole of the golf club head; wherein the slot interior surface further comprises only a central weight position and a heel weight position and devoid of a toe weight position; wherein the central weight position and the heel weight position comprise weight assembly attachment points; wherein the golf club head further comprises a moveable weight assembly; and wherein the weight assembly is only detachably affixed to one of the central weight position and the heel weight position.

Clause 19. The hollow golf club head of clause 10, wherein the mass of the faceplate is between approximately 61 grams and 62 grams.

Clause 20. The hollow golf club head of clause 10, wherein the mass of the faceplate is 62.8 grams.

What is claimed is:

1. A hollow golf club head comprising:

a crown, a sole, a strike face, a toe end, a heel end, and a rear; wherein the crown, sole, strike face, and rear combine to form an interior cavity;

wherein the strike face is opposite the rear, and adjacent the crown and the sole;

wherein the sole is resting on a ground plane when the golf club head is at an address position;

wherein the toe end is opposite the heel end, and the sole is opposite the crown;

wherein the strike face further comprises a geometric center point and a mid-plane extending through the geometric center point in a direction from the strike face to rear of the golf club head;

wherein the mid-plane is perpendicular to the ground plane;

wherein the golf club head further comprises a crown transition region;

wherein the crown transition region is formed between the strike face and the crown and comprises a crown transition region radius of curvature ranging between 0.30 inch and 0.80 inch;

wherein the crown transition region comprises a first transition region thickness;

wherein the golf club head further comprises a crown-to-faceplate bridge;

wherein the crown-to-faceplate bridge is located entirely within the crown transition region such that the crown-to-faceplate bridge comprises a crown-to-faceplate bridge radius of curvature that the crown-to-faceplate bridge radius of curvature is equal to the crown transition region radius of curvature;

wherein the crown-to-faceplate bridge comprises a first reinforcement region thickness;

wherein the first reinforcement region thickness is greater than the first transition region thickness;

wherein the rear of the golf club head further comprises a single slot; wherein the single slot defines: a slot interior surface, a slot bottom surface, a slot top surface, and two slot sidewalls; wherein the slot interior surface, slot bottom surface, slot top surface, and two slot sidewalls cooperate to form a slot channel opening to an exterior rear and sole of the golf club head;

wherein the slot interior surface further comprises a central weight position and a heel weight position; wherein the central weight position and the heel weight position comprise threaded weight assembly attachment points;

wherein the golf club head further comprises a moveable weight assembly; and wherein the moveable weight assembly is detachably affixed to one of the central weight position and the heel weight position with a threaded fastener.

2. The hollow golf club head of claim 1, wherein slot interior surface is devoid of a toe weight position.

3. The hollow golf club head of claim 1, wherein a mass of the golf club head ranged from 190 to 200 grams and a volume of the golf club head ranged from 444 cc to 460 cc, such that a club head mass-to-volume ratio is between 0.40 and 0.44.

4. The hollow golf club head of claim 3, wherein a golf club head center of gravity is greater than 43 mm, measured from the geometric center point of the strike face and parallel to the ground plane.

5. The hollow golf club head of claim 4, wherein the crown-to-faceplate bridge further comprises a first reinforcement region width measured in a heel-to-toe direction and a first reinforcement region length measured in a front-to-rear direction; and wherein the first reinforcement region width varies along the first reinforcement region length.

6. The hollow golf club head of claim 5, wherein the crown-to-faceplate bridge is integrally formed within the crown transition region.

7. A hollow golf club head comprising:

a crown, a sole, a strike face, a toe end, a heel end, and a rear; wherein the crown, sole, strike face, and rear combine to form an interior cavity;

wherein the strike face is opposite the rear, and adjacent the crown and the sole;

wherein the strike face comprises a variable thickness profile;

wherein the sole is resting on a ground plane when the golf club head is at an address position;

wherein the toe end is opposite the heel end, and the sole is opposite the crown;

wherein the strike face further comprises a geometric center point and a mid-plane extending through the geometric center point in a direction from the strike face to rear of the golf club head;

wherein the mid-plane is perpendicular to the ground plane;

wherein the golf club head further comprises a crown transition region;

wherein the crown transition region is formed between the strike face and the crown and comprises a crown transition region radius of curvature ranging between 0.30 inch and 0.80 inch;

wherein the crown transition region comprises a first transition region thickness;

wherein the golf club head further comprises a crown-to-faceplate bridge;

wherein the crown-to-faceplate bridge is located entirely within the crown transition region such that the crown-to-faceplate bridge comprises a crown-to-faceplate bridge radius of curvature that the crown-to-faceplate bridge radius of curvature is equal to the crown transition region radius of curvature;

wherein the crown-to-faceplate bridge comprises a first reinforcement region thickness;

wherein the first reinforcement region thickness is greater than the first transition region thickness;

wherein the rear of the golf club head further comprises a single slot; wherein the single slot defines: a slot interior surface, a slot bottom surface, a slot top surface, and two slot sidewalls; wherein the slot interior surface, slot bottom surface, slot top surface, and two slot sidewalls cooperate to form a slot channel opening to an exterior rear and sole of the golf club head;

wherein the slot interior surface further comprises a central weight position and a heel weight position; wherein the central weight position and the heel weight position comprise threaded weight assembly attachment points;

wherein the golf club head further comprises a moveable weight assembly; and wherein the moveable weight assembly is detachably affixed to one of the central weight position and the heel weight position with a threaded fastener.

8. The hollow golf club head of claim 7, wherein the strike face further comprises a perimeter edge region, a toe region, a heel region, an upper transition region, a lower transition region, and a center region.

9. The hollow golf club head of claim 8, wherein the toe region has a first thickness and the heel region has a second thickness; wherein the first thickness is greater than the second thickness.

10. The hollow golf club head of claim 9, wherein the center region has a third thickness; wherein the third thickness is greater than the first thickness and second thickness.

11. The hollow golf club head of claim 10, wherein the first thickness is between approximately 0.081 inches and 0.087 inches.

12. The hollow golf club head of claim 11, wherein the second thickness is between approximately 0.075 and 0.080 inches.

13. The hollow golf club head of claim 12, wherein third thickness is between approximately 0.100 and 0.150 inches.

14. The hollow golf club head of claim 13, wherein a mass of the strike face is less than 63 grams.

15. The hollow golf club head of claim 14, wherein a mass of the golf club head ranged from 190 grams to 200 grams and a volume of the golf club head ranged from 444 cc to 460 cc, such that a club head mass-to-volume ratio is between 0.40 and 0.44.

16. The hollow golf club head of claim 15, wherein a golf club head center of gravity is greater than 43 mm, measured from the geometric center point of the strike face and parallel to the ground plane.

17. The hollow golf club head of claim 16, wherein the crown-to-faceplate bridge is integrally formed within the crown transition region.

* * * * *